US006290345B1

(12) United States Patent
Sasaki et al.

(10) Patent No.: US 6,290,345 B1
(45) **Date of Patent: *Sep. 18, 2001**

(54) LIQUID CONTAINER, MANUFACTURING METHOD, INK JET CARTRIDGE, AND INK JET RECORDING APPARATUS

(75) Inventors: Toshiaki Sasaki, Irvine, CA (US); Hidehisa Matsumoto, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/804,402

(22) Filed: Feb. 21, 1997

(30) Foreign Application Priority Data

Feb. 23, 1996 (JP) ..... 8-036531
Feb. 12, 1997 (JP) ..... 9-027736

(51) Int. Cl.[7] ..... B41J 2/175

(52) U.S. Cl. ..... 347/86

(58) Field of Search ..... 347/85, 86, 87; 215/12.1; 428/90

(56) References Cited

U.S. PATENT DOCUMENTS

| | | | |
|---|---|---|---|
| 4,422,084 | 12/1983 | Saito | 347/7 |
| 4,509,062 | 4/1985 | Low et al. | 347/87 |
| 4,689,642 | 8/1987 | Sugitani | 347/87 |
| 5,435,452 | 7/1995 | Nishigami et al. | 215/12.1 |
| 5,440,333 | 8/1995 | Sykora et al. | 347/87 |

FOREIGN PATENT DOCUMENTS

| | | | |
|---|---|---|---|
| 0519452 | 12/1992 | (EP) | B41J/2/175 |
| 0543315 | 5/1993 | (EP) | B41J/2/175 |
| 543315 | 5/1993 | (EP) . | |
| 560398 | 9/1993 | (EP) . | |
| 0570981 | 11/1993 | (EP) | B41J/2/175 |
| 661160 | 7/1995 | (EP) . | |
| 738605 | 10/1996 | (EP) . | |
| 56067269 | 6/1981 | (JP) . | |
| 61-93246 | 5/1986 | (JP) . | |
| 63-12427 | 1/1988 | (JP) . | |
| 4267727 | 9/1992 | (JP) . | |
| 4339759 | 11/1992 | (JP) . | |
| 5-77345 | 3/1993 | (JP) . | |
| 5213372 | 8/1993 | (JP) . | |
| 5213373 | 8/1993 | (JP) . | |
| 5254144 | 10/1993 | (JP) . | |
| 6-13099 | 1/1994 | (JP) . | |
| 6-27523 | 2/1994 | (JP) . | |
| 06226993 | 8/1994 | (JP) . | |
| 6211243 | 8/1994 | (JP) . | |
| WO91/07240 | 5/1991 | (WO) . | |

*Primary Examiner*—N. Le
*Assistant Examiner*—Anh T. N. Vo
(74) *Attorney, Agent, or Firm*—Fitzpatrick, Cella, Harper & Scinto

(57) ABSTRACT

A liquid container includes a polyhedron outer wall having a substantial air vent and having a corner portion defined by extensions of two surfaces thereof; an inner wall forming a liquid containing portion for containing liquid therein, the inner wall including an outer surface having a shape equivalent or similar to an inner shape of the outer wall, and having a corner portion corresponding to the corner portion of the outer wall; a liquid supply portion for supplying the liquid from the liquid containing portion to outside; wherein the inner wall and outer wall have major surfaces having maximum areas and not provided with the liquid supply portion; wherein when the liquid is discharged through the liquid supply portion, the inner wall deforms such that at least one of angles formed between one side constituting a polygonal shape in a plane perpendicular to the major surface of the inner wall of the liquid container and sides adjacent thereto, decreases, and such that angles formed between the sides forming the decreasing angle and sides which are adjacent to the decreasing angle forming sides and which are not the decreasing angle forming sides, increases.

22 Claims, 13 Drawing Sheets

(a)

(b)

LIQUID CONTAINER, MANUFACTURING METHOD, INK JET CARTRIDGE, AND INK JET RECORDING APPARATUS

FIELD OF THE INVENTION AND RELATED ART

The present invention relates to a liquid accommodating container for supplying liquid out with a negative pressure to a recording station such as a pen, ink ejection portion or the like, a manufacturing method for the container, an ink jet cartridge containing the container portion and an ink jet recording head portion, and an ink jet recording apparatus.

A container for accommodating liquid is known wherein the liquid is supplied out of the container while maintaining a negative pressure within the container. Such a container performs appropriate liquid supply for the liquid using portion such as a nib or tip of a pen or recording head connected to the container, by the negative pressure produced by the container per se.

Various liquid accommodating containers of this type are used, but the usable ranges thereof are rather limited. One of the reasons for this is that there has not been a one which is easy to manufacture and which is a simple in structure.

For example, in the field of the ink jet recording requiring a proper negative pressure property, a container having a sponge therein as a generation source for the negative pressure or a bladder-like container having a spring providing force against an inward deformation due to the consumption of the ink, as disclosed in Japanese Laid Open Patent Application No. SHO-56-67269, Japanese Laid Open Patent Application No. HEI-6-226993, for example. U.S. Pat. No. 4,509,062 discloses an ink accommodation portion of rubber having a conical configuration with a rounded top having a smaller thickness than the other portion. The round thinner portion of the circular cone portion provides a portion which displaces and deforms earlier than the other portion. These examples have been put into practice, and are satisfactory at present. However, the negative pressure generating mechanisms described above is relatively expensive, and therefore, does not suit for the writing devices such as markers, plotters having writing tips. The use of the complicated negative pressure generating mechanism is not desirable since it result in bulkiness of the writing device. In writing devices, the use is made with a felt capable of generating a negative pressure and of introducing the air from the tip to permit supply of the ink thereto. The main problem of this type of the gas-liquid exchange structure for the ink supply is the ink leakage at the tip. In order to solve this problem, an ink retaining mechanism has been proposed wherein a great number of fins are formed at predetermined intervals between the tip and the liquid accommodating container extending in a direction perpendicular to the ink supply direction, for the purpose of preventing the ink leakage by retaining the ink which is going to leak upon the ambient condition change or the like. However, such a mechanism results in a relatively large amount of non-usable ink remaining in the container.

The ink supplying system of such writing devices, generally uses an open type, which leads to evaporation of the ink, with the result of reduction of the usable amount of the ink. Therefore, ink evaporation suppression by using substantial sealed type is desirable.

The description will be made briefly about the substantially sealed type in the ink jet recording. When a negative pressure generation source is not used in an ink supplying system, the ink is supplied using the level difference relative to the ink using portion(ink ejection head), that is, the static head difference. This does not require any special condition in the ink accommodation portion, and therefore, a simple ink accommodation bladder is used in many cases.

However, in order to use a closed system, the ink supply path has to extend between the ink accommodation bladder to the ink using portion(ink ejection head) thereabove with the result that long ink supply tube is required, so that system is bulky. In order to reduce or eliminate the static head difference of the ink supply path, an ink container capable of providing the ink ejection head with a negative pressure, has been proposed and put into practice. Here, a term "head cartridge" is used to cover an unified head and ink container.

The head cartridge is further classified into a type wherein the recording head and the ink accommodating portion are always unified, and a type wherein the recording means and the ink accommodating portion are separable, and are separately mountable to the recording device, but are unified in use.

In either structure, the connecting portion of the ink accommodating portion relative to the recording means is provided at a position lower than the center of the ink accommodating portion in order to increase the usage efficiency of ink accommodated in the ink accommodating portion. In order to stably maintain the ink and to prevent the ink leakage from the ejection portion such as a nozzle in the recording means, the ink accommodating portion in the head cartridge is given a function of generating a back pressure against the ink to the recording means. The back pressure is called "negative pressure", since it provides negative pressure relative to the ambient pressure at the ejection outlet portion.

In order to produce the negative pressure, the use may be made with capillary force of a porous material or member. The ink container using the method, comprises a porous material such as a sponge contained and preferably compressed in the entirety of the ink container, and an air vent for introducing air thereinto to facilitate the ink supply during the printing.

However, when the porous material is used as an ink retaining member, the ink accommodation efficiency per unit volume is low. In order to provide a solution to this problem, the porous material is contained in only a part of the ink container rather than in the entirety of the ink container in a proposal. With such a structure, the ink accommodation efficiency and ink retaining performance per unit volume is larger than the structure having the porous material in the entirety of the ink container.

From the standpoint of improving the ink accommodation efficiency, the bladder-like container using or not using the spring, or the ink accommodating container of rubber is usable.

Such an ink container is widely used now.

However, further improvement is desired.

For example, further increase of the ink accommodation efficiency is desirable. More particularly, a larger amount of the ink is desired to be contained in the same volume of the container. The smaller number-of parts constituting the ink container and simpler container are desirable.

SUMMARY OF THE INVENTION

Accordingly, it is a principal object of the present invention to provide an liquid accommodating container wherein the liquid can be supplied out with a stabilized negative pressure.

It is another object of the present invention to provide a negative pressure using type liquid accommodating container, a manufacturing method therefor, and a manufacturing apparatus, wherein the inside space of a container can be used to the maximum to accommodate the ink, and the variation of the quality is low.

It is a further object of the present invention to provide a liquid supply system and a liquid accommodating container usable therewith, wherein a static head difference is used, and size is small.

It is a further object of the present invention to provide a liquid accommodating container which is particularly suitable to an ink jet head.

According to an aspect of the present invention, there is provided a liquid container comprising: a polyhedron outer wall having a substantial air vent and having a corner portion defined by extensions of two surfaces thereof; an inner wall forming a liquid containing portion for containing liquid therein, said inner wall including an outer surface having a shape equivalent or similar to an inner shape of said outer wall, and having a corner portion corresponding to the corner portion of said outer wall; a liquid supply portion for supplying the liquid from the liquid containing portion to outside; wherein said inner wall and outer wall have major surfaces having maximum areas and not provided with said liquid supply portion; wherein when the liquid is discharged through said liquid supply portion, said inner wall deforms such that at least one of angles formed between one side constituting a polygonal shape in a plane perpendicular to the major surface of said inner wall of said liquid container and sides adjacent thereto, decreases, and such that angles formed between the sides forming the decreasing angle and sides which are adjacent to the decreasing angle forming sides and which are not the decreasing angle forming sides, increases.

According to another aspect of the present invention, there is provided a liquid container comprising: a polyhedron outer wall having a substantial air vent and having a corner portion defined by extensions of two surfaces thereof; an inner wall forming a liquid containing portion for containing liquid therein, said inner wall including an outer surface having a shape equivalent or similar to an inner shape of said outer wall, and having a corner portion corresponding to the corner portion of said outer wall; a liquid supply portion for supplying the liquid from the liquid containing portion to outside; wherein said inner wall and outer wall have major surfaces having maximum areas and not provided with said liquid supply portion; wherein at least one of angles formed between one side constituting a polygonal shape in a plane perpendicular to the major surface of said inner wall of said liquid container and sides adjacent thereto is larger than 0 degree and smaller than 90 degrees; and wherein angles formed between the sides forming the decreasing angle and sides which are adjacent to the decreasing angle forming sides and which are not the decreasing angle forming sides, are larger than 90 degrees and smaller than 180 degrees.

According to a further aspect of the present invention, there is provided a liquid container comprising: a polyhedron outer wall having a substantial air vent and having a corner portion defined by extensions of two surfaces thereof; an inner wall forming a liquid containing portion for containing liquid therein, said inner wall including an outer surface having a shape equivalent or similar to an inner shape of said outer wall, and having a corner portions corresponding to the corner portions of said outer wall; a liquid supply portion for supplying the liquid from the liquid containing portion to outside; wherein the corner portion of said inner wall includes a first corner portion which is disengageable from a corresponding corner portion of said outer wall when the liquid is discharged and a second corner portions which is retained even when the liquid is discharged.

According to a further aspect of the present invention, there is provided a liquid container comprising: an outer wall provided with a substantial air vent; an inner wall forming a liquid containing portion for containing liquid therein, said inner wall including an outer surface having a shape equivalent or similar to an inner shape of said outer wall; a liquid supply portion for supplying the liquid from the liquid containing portion to outside; wherein said inner wall has a bent portion which is disengageable from a corresponding portion of said outer wall when the liquid is discharged, said bent portion being provided at a position faced to a major surface of said liquid accommodating container having a maximum area.

Firstly, the container may be such that an outer side of said inner wall is all separated physically from said outer wall except for a portion which is closely contacted to said outer wall.

Secondly, the container may be such that a pinch-off portion where said inner wall is pinched by said outer wall, is provided at a portion other than the major surfaces.

Thirdly, the container may be such that said liquid supply portion is provided with a liquid discharge permission member.

Fourthly, the container may be such that a plurality of such pinch-off portions are provided at opposite positions.

These features may be used alone or in combination.

The present invention is particularly effectively applicable to a liquid ejection head cartridge or liquid ejection recording device wherein recording is effected by ejecting liquid as in ink jet recording field.

According to a further aspect of the present invention, there is provided a liquid ejection head cartridge having a liquid container for containing liquid and a liquid ejection recording head connected to a liquid supply portion of said liquid container, comprising: said liquid container including: an outer wall provided with a liquid accommodating container air vent; an inner wall forming a liquid containing portion for containing liquid therein, said inner wall including an outer surface having a shape equivalent or similar to an inner shape of said outer wall; a liquid supply portion for supplying the liquid from the liquid containing portion to outside; wherein said inner wall has a bent portion which is disengageable from a corresponding portion of said outer wall when the liquid is discharged, said bent portion being provided at a position faced to a major surface of said liquid accommodating container having a maximum area.

According to a further aspect of the present invention, there is provided a liquid ejecting recording apparatus, comprising: a liquid ejection head cartridge; said liquid ejection cartridge including: a liquid container including an outer wall provided with a substantial air vent; an inner wall forming a liquid containing portion for containing liquid therein, said inner wall including an outer surface having a shape equivalent or similar to an inner shape of said outer wall; a liquid supply portion for supplying the liquid from the liquid containing portion to outside; Wherein said inner wall has a bent portion which is disengageable from a corresponding portion of said outer wall when the liquid is discharged, said bent portion being provided at a position faced to a major surface of said liquid accommodating container having a maximum area; and a liquid ejection head connectable with the liquid supply portion of said liquid container; said apparatus further comprising a carriage for scanning motion, said carriage is capable of detachably mounting said cartridge.

According to a further aspect of the present invention, there is provided a method for manufacturing a liquid container including an outer wall provided with a substantial air vent; an inner wall forming a liquid containing portion for containing liquid therein, said inner wall including an outer surface having a shape equivalent or similar to an inner shape of said outer wall; a liquid supply portion for supplying the liquid from the liquid containing portion to outside; Wherein said inner wall has a bent portion which is disengageable from a corresponding portion of said outer wall when the liquid is discharged, said bent portion being provided at a position faced to a major surface of said liquid accommodating container having a maximum area, said method comprising: preparing a mold corresponding to an outer shape-of said liquid container, a first parison for the outer wall which is cylindrical in shape and has a diameter smaller than said mold, and a second parison for the inner wall; and injecting air to expansion said first and second parison to said mold so that region formed by the inner wall and a region formed by the outer wall are separable and substantially similar figure in shape.

According to a further aspect of the present invention, there is provided a method for manufacturing comprising: preparing a liquid container including an outer wall provided with a substantial air vent; an inner wall forming a liquid containing portion for containing liquid therein, said inner wall including an outer surface having a shape equivalent or similar to an inner shape of said outer wall; a liquid supply portion for supplying the liquid from the liquid containing portion to outside; Wherein said inner wall has a bent portion which is disengageable from a corresponding portion of said outer wall when the liquid is discharged, said bent portion being provided at a position faced to a major surface of said liquid accommodating container having a maximum area, said method-comprising: separating the inner wall and the outer wall by pressure reduction of the liquid containing portion; supplying the liquid into said liquid containing portion.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

In the following the description will be made as to an ink container usable with ink jet recording, as an example, but the present invention is applicable to a recording pen or a liquid accommodating container using negative pressure to properly supply liquid to the outside.

(Operational Principle)

Referring to FIGS. 1, 2, 5 and 13, the description will first be made as to a mechanism of stabilized negative pressure production and maintenance thereof which is one of the features of the present invention.

Figure 1:
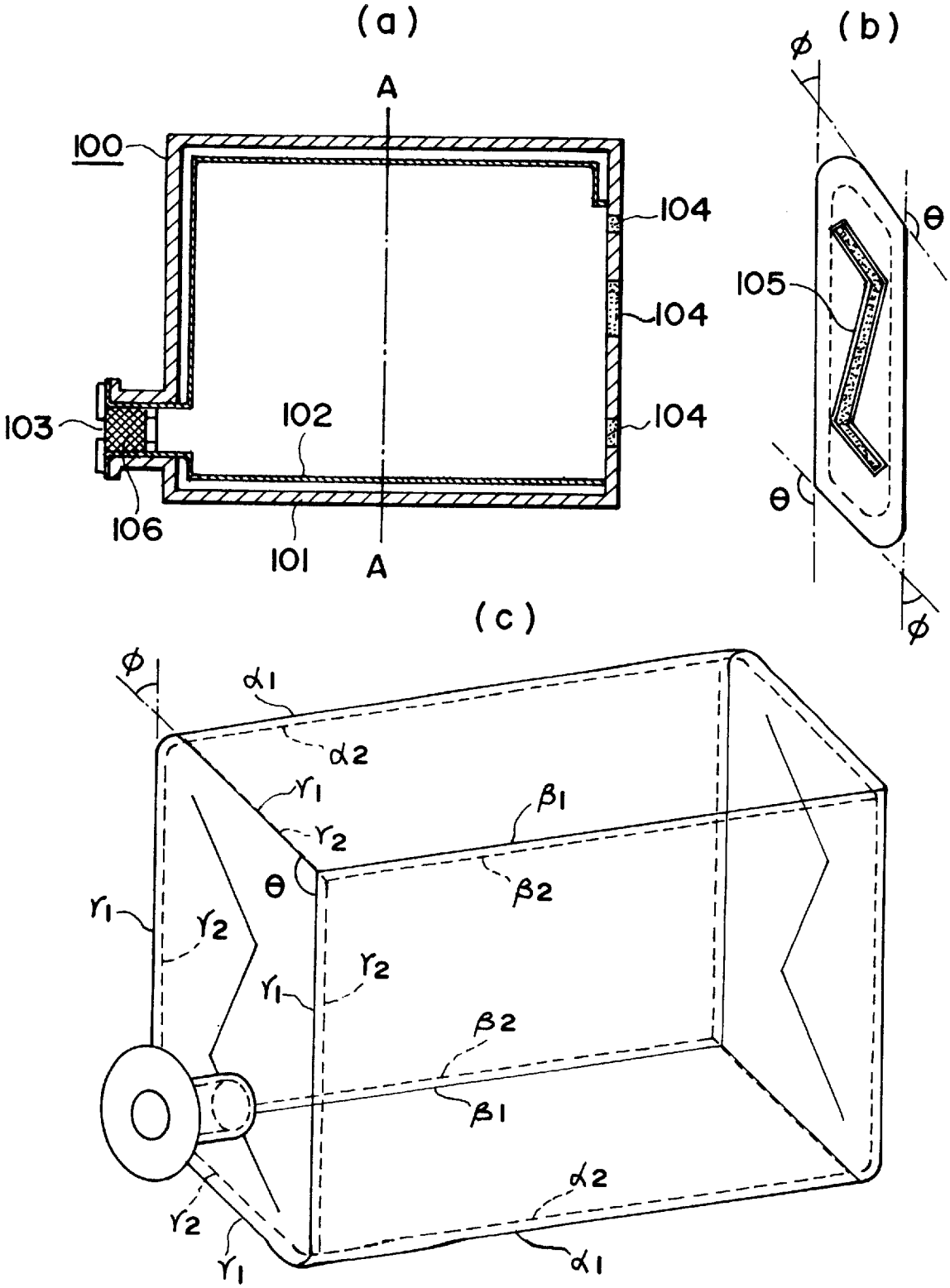
FIGS. 1(*a*), 1(*b*) and 1(*c*) are schematic views of an ink container according to an embodiment of the present invention, wherein (*a*) is a sectional view, (*b*) is a bottom view, and (*c*) is a perspective view.
Figure 2:
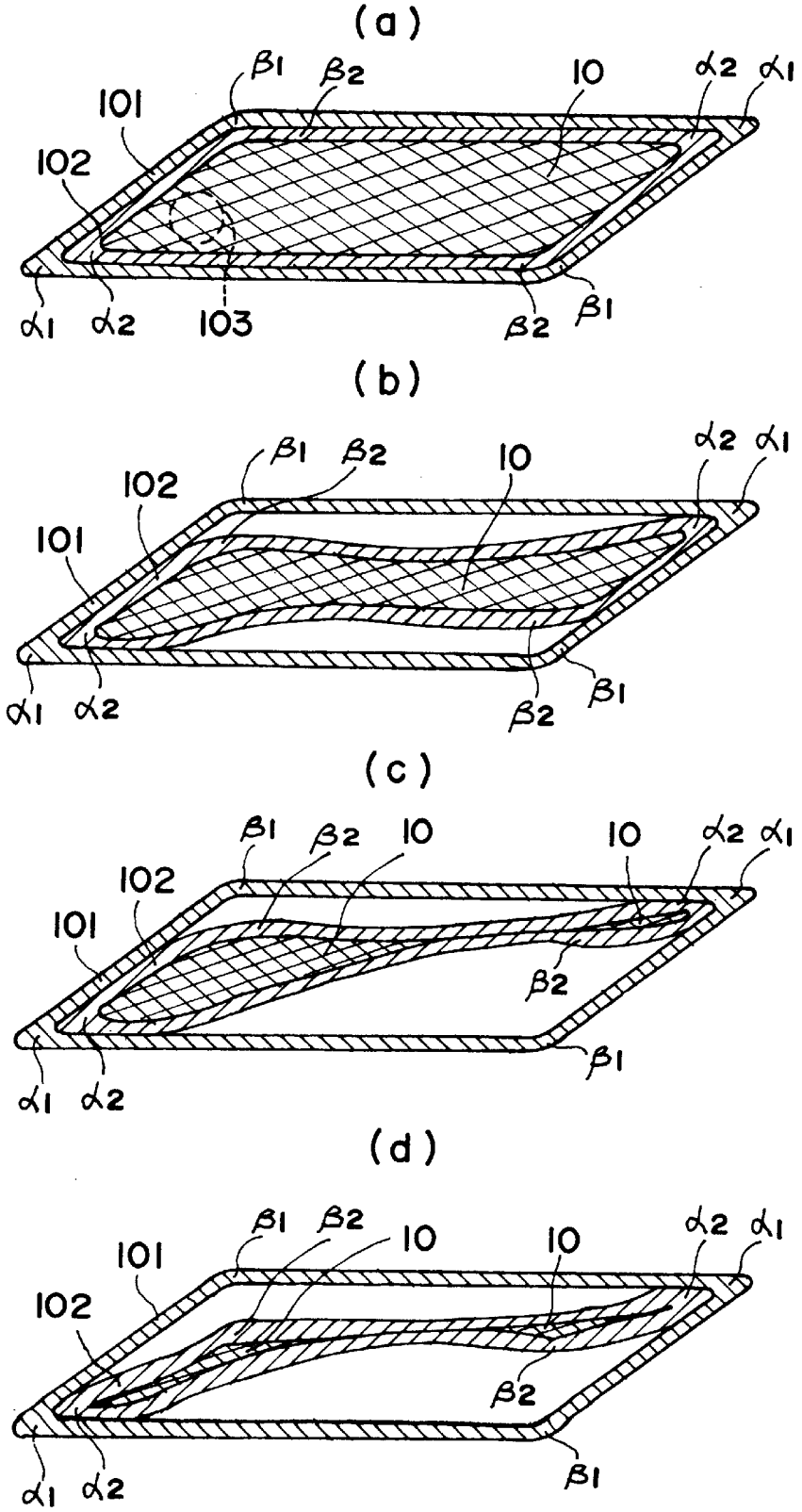
FIGS. 2(*a*), 2(*b*), 2(*c*) and 2(*d*) are schematic view showing deformation resulting from ink discharge of an ink container shown in FIG. 1.

FIGS. 1((*a*)–(*c*)) shows a structure of an ink container according to an embodiment of the present invention, wherein (*a*) is a sectional view, (*b*) is a side view, and (*c*) is a perspective view. FIG. 2 is sectional views taken along A—A in FIG. 1(*a*), and shows the change when the ink in the ink container is discharged from an ink supplying portion of ink container after it is filled with the ink ((*a*)–(*d*)) FIGS. 5((*a*)–(*c*)) illustrates an angle of a corner portion of the ink container of the present invention. The ink container of this embodiment is manufactured through a direct blow molding, with which an inner wall and an outer wall of the ink container are simultaneously molded through one step.

The ink container 100 of FIG. 1 contains the ink in a zone (ink accommodating portion) enclosed with an inner wall 102 separable from an outer wall 101 forming an outer shell. The outer wall 101 has a thickness sufficiently larger than the inner wall 102, and therefore, it hardly deforms even when the inner wall 102 deforms due to discharging of the ink. The outer wall is provided with an air vent 105. The inner wall has a welded portion(pinch-off portion)104, and the inner wall is supported by and engaged with the outer wall at the welded portion.

The ink container 100 of FIG. 1 comprises a substantially quadratic prism portion having a parallelogram bottom surface and a cylindrical ink supplying portion 103 connected thereto, as a curved portion. The ink container has a small curved or rounded portion (R) at a portion corresponding to the edge lines of the prism shape. Here, the portion of the container adjacent the crossing portion between two surfaces preferably two flat surfaces or the crossing portion of the extensions of the surfaces, are called a "corner portion". The surfaces having the maximum area among the surfaces defined by the corner portion in each of the inner and outer walls, are faced to each other at both of the lateral sides of the ink supplying portion 103.

Figure 5:
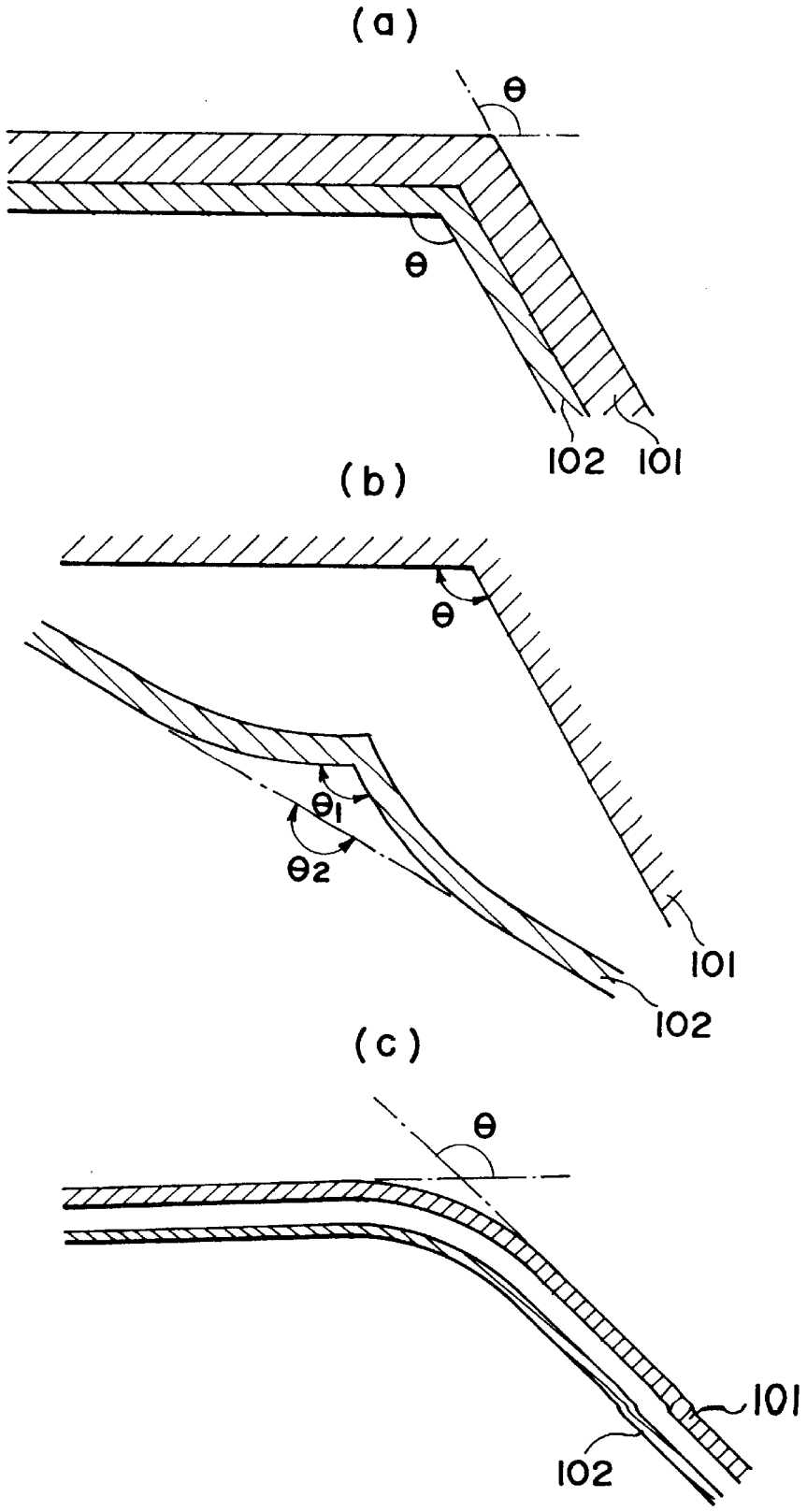
FIGS. 5(*a*), 5(*b*) and 5(*c*) illustrate the definition of an angle at a corner portion of a liquid accommodating container according to the present invention.

In FIG. 1(*b*), θ and ϕ are angles formed between outer walls constituting the corner portion of the ink container, more particularly, they are angles formed at the crossing portion of extensions of two surfaces, as shown in FIGS. 5(*a*), (*c*). Angle θ is larger than 90 degrees, and angle ϕ is smaller than 90 degrees. In this embodiment, θ is approx. 140 degrees, and ϕ is approx. 40 degrees. The angle of the outer wall can be easily controlled since the manufacturing of the ink container carried out on the basis of the outer wall, as will be described hereinafter. The inner wall is formed so as to be corresponding to the outer wall, and therefore, the angles of the inner wall upon the start of use (initial state) are substantially the same as the angles of the corresponding portions of outer wall. The ink container of this embodiment has a substantially prism configuration, and when it is cut along a plane parallel to the bottom surface, as shown in FIG. 2, the surface taken along the plane has a substantially parallelogram configuration. At least one of the angles formed between one side and adjacent side of the polygonal shape is larger than 0 degree and less than 90 degrees, and the angles formed between said two sides and the sides which are different from the two sides and which are adjacent said two sides, are larger than 90 degrees and smaller than 180 degrees, respectively. The cutting plane is perpendicular to the maximum area surfaces.

The ink supplying portion 103 is connected with an unshown ink jet recording means through an ink discharge permission member 106 having an ink leakage preventing function capable of preventing leakage of the ink when small vibration or external pressure is imparted to the container. At the ink supplying portion 103, the inner wall and the outer wall are not easily separated from each other by the ink discharge permission member 106 and another structure therearound. The size of the ink supplying portion is sufficiently small as compared with the ink accommodating portion, and therefore, the ink supplying portion is not easily collapsed even when the deformation of the inner wall resulting from the discharge of the ink. Therefore, even when the ink is completely consumed, the inner wall and the outer wall are not deformed at the ink supplying portion and maintain the initial state.

Since FIG. 1 is a schematic view, it seems that space exists between the outer wall 101 and the inner wall 102 of the ink container. But, it will suffice, if they are separable, and the inner wall and the outer wall may be in contact with each other, or may be spaced with a small gap. In any case, the corner portion of the inner wall is disposed at a position at least corresponding to the corner portion of the outer wall along the configuration of the inner surface of the outer wall 101, in the initial state shown in FIG. 2(*a*).

In FIG. 2, designated by 10 is the ink. In FIG. 2(*a*), the position of the corresponding ink supplying portion 103 is indicated by broken line, but in FIGS. 2(*b*)–(*d*), the position of the ink supplying portion is omitted for better understanding of the deformation of the inner wall.

When the ink is ejected from the ink jet recording head of the ink jet recording means, the ink is consumed from the ink accommodating portion, and the maximum area sides of the inner wall 102 of the ink container begins to deform at the central portions thereof in the direction of reducing the volume of the ink accommodating portion.

The corner portion α1 shown in FIG. 1(*c*) among the corner portions of the outer wall, limits the movement of the corner portion α2 of the inner wall to keep the positional relation therebetween. On the other hand, the corner portion β2 of the inner wall is disengaged from the correspondence corner portion of the outer wall to suppress the deformation of the inner wall. In other words, as regards the polygonal shape on the cutting plane(in the case of FIG. 2, the cutting plane parallel to the bottom surface) perpendicular to the maximum area surface of the ink container inner wall, the deformation occurs such that one (ϕ) of the angles formed between a side and a side adjacent thereto is reduced, and that angles (θ) formed between the sides forming said angle and the sides adjacent thereto, are increased.

This occurs because the angles of the polygonal shape formed in the cutting plane are different, and therefore, the forces applied resulting from the ink discharge at the angle reducing corner (α2) and the angle increasing corners (α1) of the inner wall, are different. As a result, the above-described position variation of the corner portion α2 hardly occurs, and therefore, the ink accommodating portion receives the deforming force due to the ink consumption and the restoring force in the direction of the initial shape, by which the negative pressure is stabilized.

At this time, the air is introduced through an air vent 105 into between the inner wall 102 and the outer wall 101, so that deformation of the inner wall is not impeded, and therefore, the stabilized negative pressure is maintained during the use or consumption of the ink. Thus, the space formed between the inner wall and the outer wall, is in fluid communication with the ambience through the air vent 105. Thereafter, the ink is retained in the ink accommodating portion by the balance between the force provided by the inner wall and the force provided by the meniscus formed at the ejection outlet of the recording head.

Furthermore, when quite a large amount of the ink is discharged out of the ink accommodating portion, and therefore, the ink accommodating portion is further deformed (FIG. 2(*c*)), the welded portion 104 also functions as a deformation limiting portion for the inner wall so that disengagement of inner wall from the outer wall is suppressed at the side having the supply port and the side faced thereto. As a result, the positional relation between the corner portion γ1 of the outer wall in the side having the supply port and the corner portion γ2 of the inner wall, is maintained, and therefore, the supply port portion is not plugged by the adjacent internal wall surface. The corner portion β2 of the inner wall disengaged from the corner portion of the outer wall, is brought into contact to the maximum area surface opposing thereto. The contact portion increases in its area by the further consumption of the ink.

Sooner or later, the ink ejection becomes not possible from the ink jet recording head. This state is shown in FIG. 2(*d*) (final state). With this state, the contact portion of the ink accommodating portion is generally as large as the entirety of the ink accommodating portion. Depending on the thickness of the inner wall, the welded portion 104 may be separated from the outer wall. In this case, the direction of the deformation is limited since the welded portion 104 has a certain length in a direction as shown in FIGS. 1(*a*) and (*b*). Therefore, even when the welded portion is disengaged from the outer wall, the deformation is not irregular but is balanced.

The foregoing is the description of the change when the ink container of the present invention is filled with the ink, and the ink is discharged from the ink supplying portion thereafter. The deformation starts at the maximum area surfaces, and the order of the deformations of various parts of the inner wall is positively determined by the provisions of the corner portion of the inner wall disengageable from the corresponding corner portion of the outer wall and the corner portion of the inner wall which is maintained, in the positional relation, with the corner portion of the outer wall.

In the foregoing description, with respect to at least one of the cutting planes perpendicular to the maximum area surface of the inner wall of the ink container, the deformation occurs such that angle formed between one side constituting the substantially polygonal shape in the cutting plane, reduces or increases. Here, the angle of the inner wall, as shown in FIG. 5(*b*), is defined as the angle θ2 formed at the crossing point between the extensions of the substantially flat surface portions of the inner wall. Therefore, even if the angle θ1 formed in the neighborhood of the corner portion hardly changes from the angle θ of the initial state, it will suffice if the θ2 changes.

Figure 13:
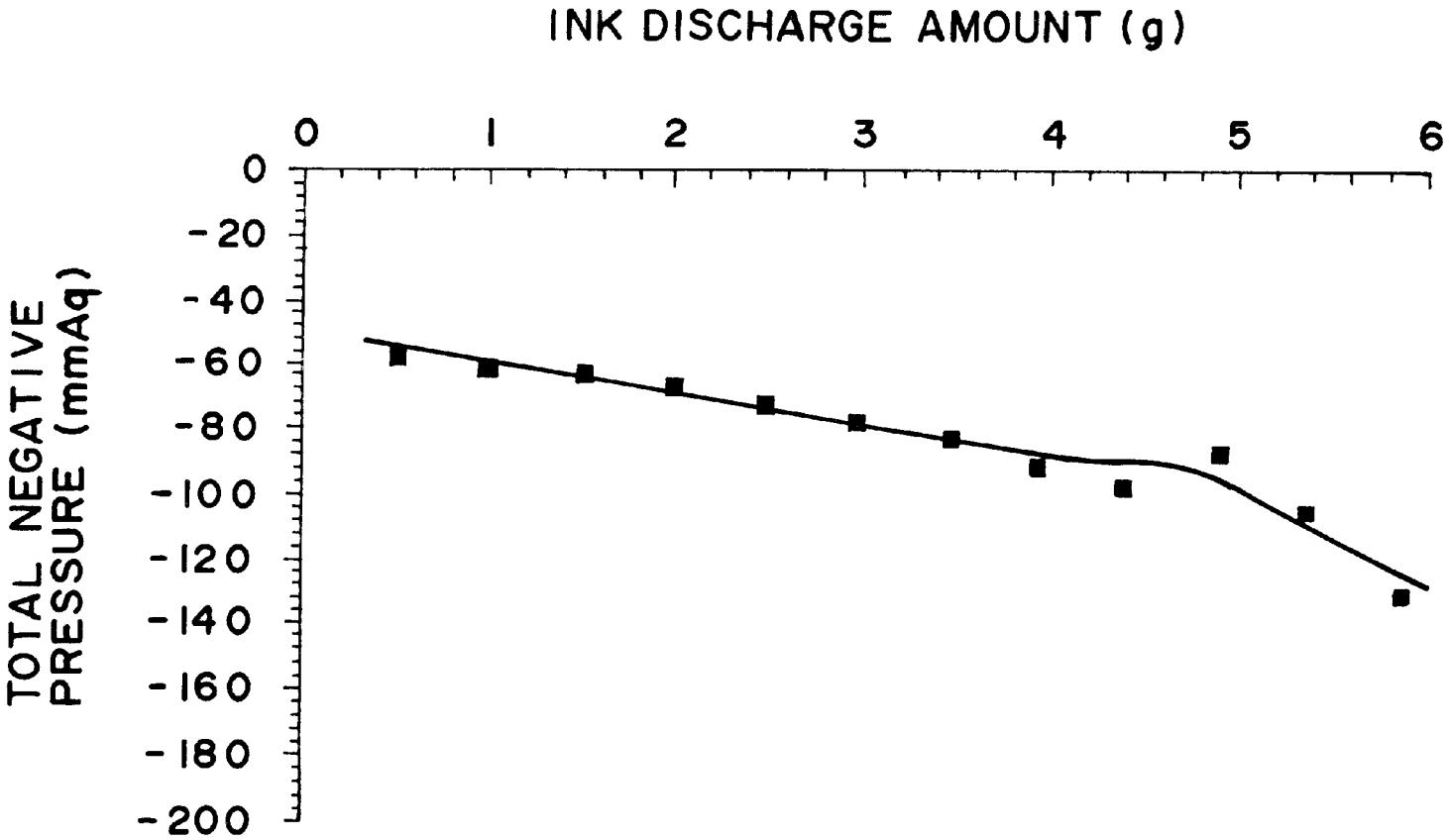
FIG. 13 shows a negative pressure property of an ink container of an embodiment of FIG. 1.

FIG. 13 shows a relation between the ink use amount from the ink accommodating portion and the negative pressure of the ink container in the present invention. FIG. 13 is a graph showing the negative pressure property of the ink container of FIG. 1 embodiment, wherein the abscissa represents the ink discharge amount to the outside, and the ordinate represents a total negative pressure.

In the ink jet recording apparatus usable with the ink container, the preferable and practical range of the total negative pressure in the ink container is approx. −50 to −200 mmAq (gauge pressure). FIG. 13 shows a result of the experiment carried out with the following conditions:

thickness of the outer wall: 1 mm thickness of the inner wall: 150 μm the surface area of the inner wall: 40 cm2 material of the outer wall: biimpact polystyrene resin material resin material of the inner wall: polyethylene resin material having an elastic modulus lower than that of the biimpact polystyrene.

It will be understood that ink container of this embodiment has sufficient functions to produce a stabilized negative pressure which is a condition peculiar to the field of the ink jet recording. It has been confirmed that performance is not influenced by external vibration. In addition, substantially the similar properties are exhibited even when the consumption amount of the ink per unit time is severer than a normal recording.

(Configuration of the Container)

The description will be made as to the configuration of the liquid accommodating container to which the present invention is applicable. As shown in FIG. 1, in the liquid accommodating container of the present invention, the corner portions of the inner wall 102 are so located that they correspond to the corner portions of outer wall 101, following the configuration of the outer wall 101. In FIG. 1(*a*), the inner wall and the outer wall are shown without the ink supplying portion 103 for better understanding. When the ink supplying portion is provided at a position faced to the welded portion 104 of the side surface of the ink container, another welded portion existences adjacent the ink supplying portion.

The inner wall has the outer surface having an equivalent or similar shape as the inner surface of the outer wall, and has the corner portions corresponding to the corner portions of the outer wall, by which the dead space having existed at the initial state in a conventional container having a casing and a bladder-like container therein, can be removed, so that ink accommodation capacity per unit volume can be increased, namely, the ink accommodation efficiency can be increased. By the provision of the air vent, the negative pressure can be limited within a desired range independently of the consumption amount of the ink per unit time since the liquid accommodating portion can easily deform when the liquid such as ink accommodated in-the ink accommodating portion (liquid accommodating portion) is supplied to the outside.

A liquid container of this embodiment includes a polyhedron outer wall provided with a substantial air vent and corner portions constituting the polyhedron; an inner wall forming a liquid containing portion for containing liquid therein, said inner wall including an outer surface having a shape equivalent or similar to an inner shape of said outer wall and corner portions corresponding to the corner portions of the inner wall; a liquid supply portion for supplying the liquid from the liquid containing portion to outside. The present invention is not limited to the container of a quadratic prism shape having a parallelogram cross-section, as shown in FIG. 1.

The present invention provides a liquid container comprising a polyhedron outer wall having a substantial air vent and having a corner portion defined by extensions of two surfaces thereof; an inner wall forming a liquid containing portion for containing liquid therein, said inner wall including an outer surface having a shape equivalent or similar to an inner shape of said outer wall, and having a corner portion corresponding to the corner portion of said outer wall; a liquid supply portion for supplying the liquid from the liquid containing portion to outside; wherein said inner wall and outer wall have major surfaces having maximum areas and not provided with said liquid supply portion; wherein when the liquid is discharged through said liquid supply portion, said inner wall deforms such that at least one of angles formed between one side constituting a polygonal shape in a plane perpendicular to the major surface of said inner wall of said liquid container and sides adjacent thereto, decreases, and such that angles formed between the sides forming the decreasing angle and sides which are adjacent to the decreasing angle forming sides and which are not the decreasing angle forming sides, increases. According to this, a predetermined one of ones of the inner wall corner portions are disengaged from the corresponding corner portion or portions, so that way of collapse of the inner container is regulated. In other words, the deformation starts at the maximum area surface or surfaces of the inner wall, and at one or ones of the corner portions of the inner wall, the inner wall are disengaged from the corner portion or portions of the outer wall, and at another one or ones of the corner portions of the inner wall are maintained at a predetermined positional relation relative to the corresponding corner portion or portions of the outer wall, so that order or way of deformation of various parts of the inner wall is regulated.

Figure 3:
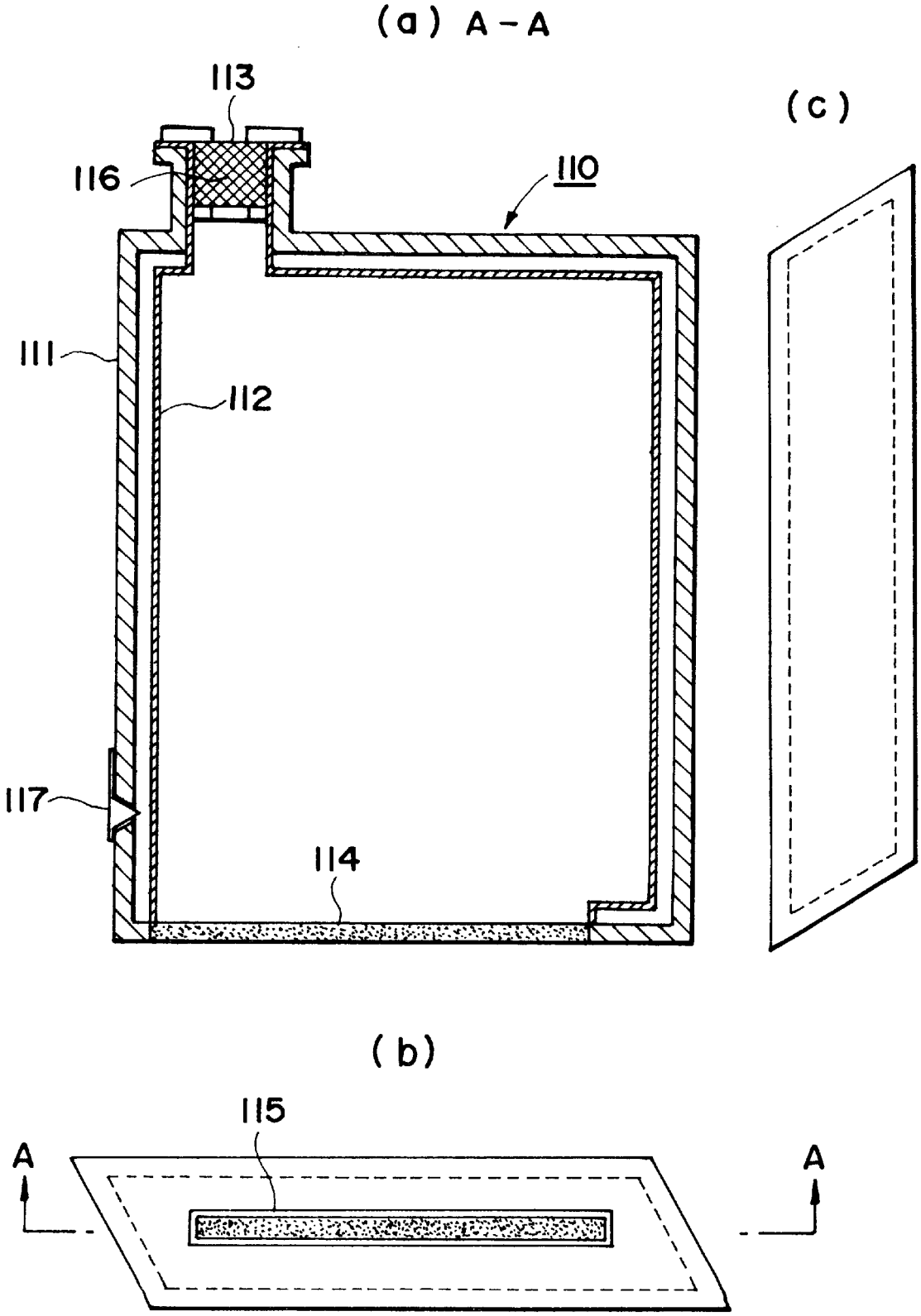
FIGS. 3(*a*), 3(*b*) and 3(*c*) are schematic view of an ink container according to another embodiment of the present invention, wherein (*a*) is a sectional view, (*b*) is a bottom view, and (*c*) is a side view.
Figure 4:
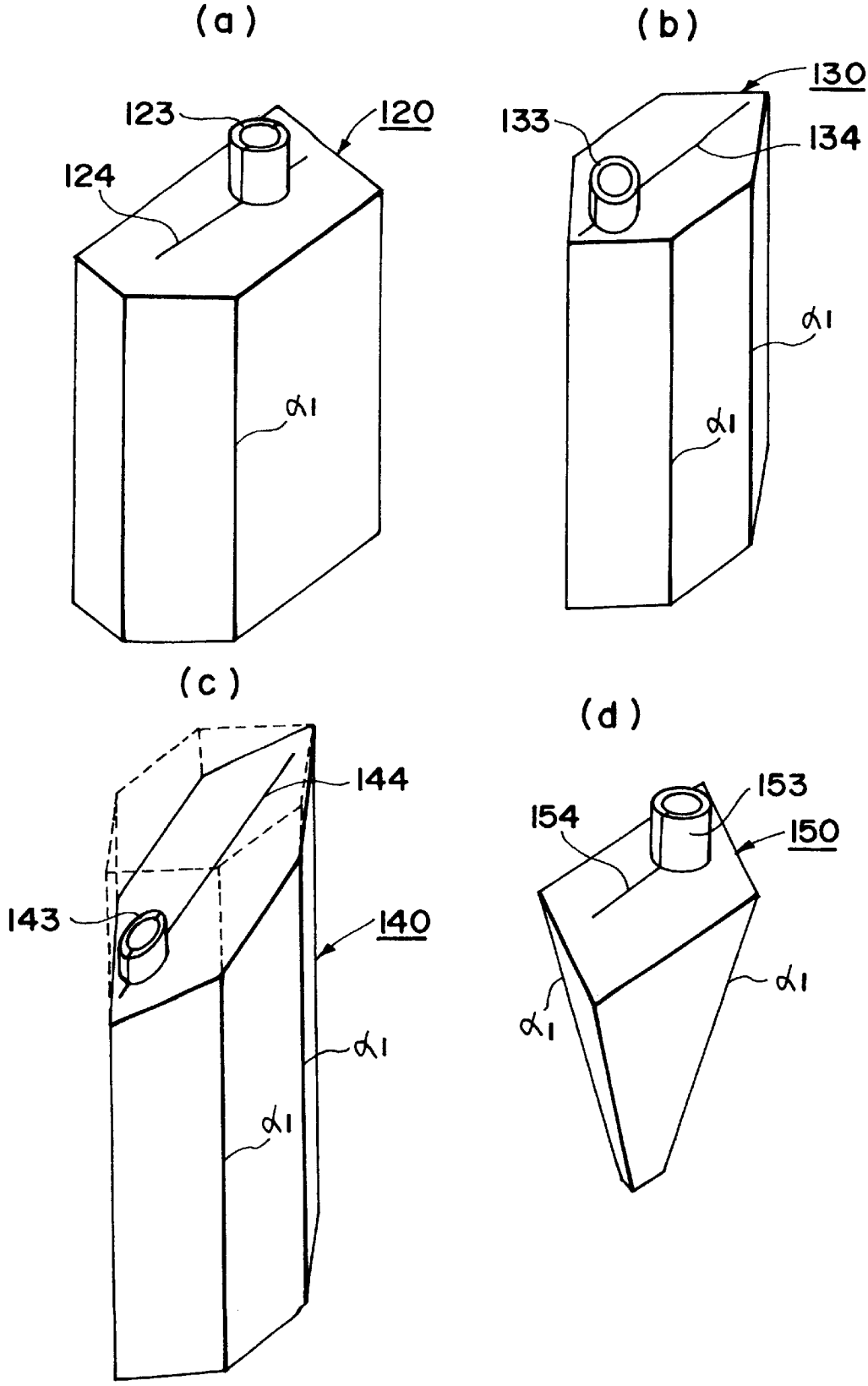
FIGS. 4(*a*), 4(*b*), 4(*c*) and 4(*d*) are schematic perspective views; showing examples of other ink containers wherein the present invention is used.

FIGS. 3 and 4(*a*)–(*d*), show other embodiments of the ink container.

FIGS. 3 shows an ink container according to another embodiment of the present invention, wherein (*a*) is a sectional view, (*b*) is a bottom view, and (*c*) is a side view. In this embodiment, the container 110 has a substantially parallel hexahedron configuration, and the bottom surface of the container, the side having an ink supply port 113, and the side surface, are not perpendicular. Therefore, the corner portion constituting the surface of inner wall 112 having the welded portion 114, is also easily disengaged from the corresponding corner portion of the outer wall 111 in accordance with the discharge of the ink. This is different from FIG. 1 embodiment. Thus, according to the present invention, the occurrence of the insufficiently collapsed portion at the final state, is minimized by its configuration. Additionally, the configuration is considered as permitting smooth deformation of the inner wall since the negative pressure is maintained in the desired range.

Figure 6:
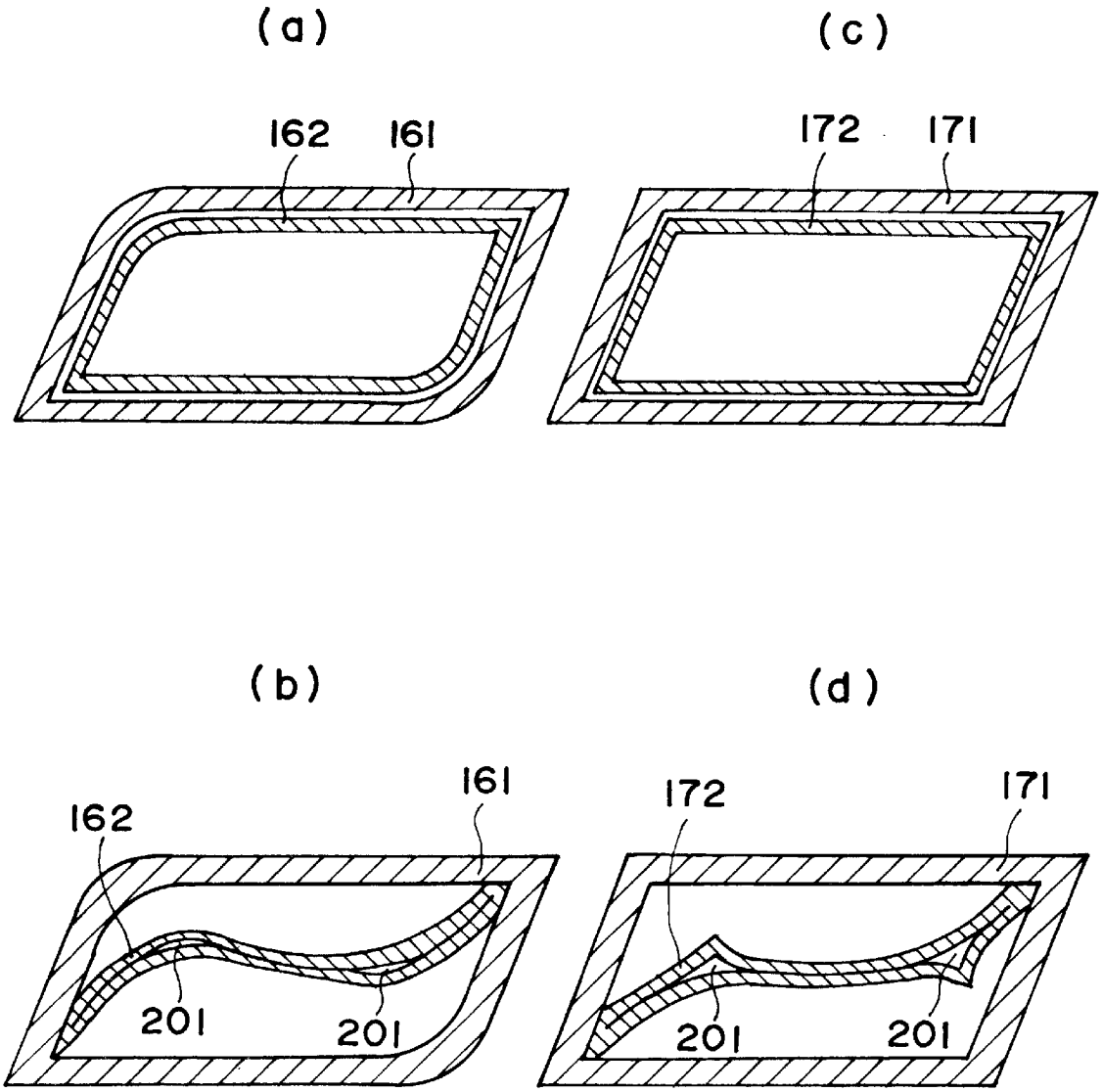
FIGS. 6(*a*), 6(*b*), 6(*c*) and 6(*d*) show an advantage of provision of rounding at a corner portion of an ink container according to the present invention.

FIGS. 4(*a*)–(*d*), shows further embodiment of the ink container. FIG. 4(*a*) shows a pentagonal prism configuration ink container; and FIG. 4(*b*) shows a hexagonal prism configuration ink container. These ink containers, similarly to the ink container of FIG. 1, include corner portions $\alpha$1 of the outer walls from which the correspondence corner portions of the inner wall are disengaged in accordance with the consumption of the ink. As shown in FIG. 4(*c*), it is not necessary that bottom surface of the container, the surface having the ink supply port and the side surface, are perpendicular. As shown in FIG. 4(*d*), the configuration is not limited to prism shape. In the ink container having a portion where the corner portion is formed by three perpendicular sides among the above-described ink containers, the corner portion of the inner wall is not easily separated from the correspondence corner portion of the outside when the inner wall deforms as a result of the use of the ink. The corner portions may be rounded. In this case, the angle is defined as an angle formed between the sides constituting a cross-section by the outer wall, as shown FIG. 5(*c*). Particularly when the portion at which the corner portion angle increases when the inner wall collapses by the consumption of the ink, is rounded (R) as shown FIG. 6(*a*), the final state is as shown in FIG. 6(*b*). When the rounding is not provided, as shown FIG. 6(*c*), the final state is as shown in FIG. 6(*d*). In the former case, the insufficiently collapsed portion at the final state is smaller. Additionally, the rounded portion is effective to promote the deformation of the ink container. For these reasons, the rounding is desirable. By employing the small curved surface configuration as the configuration of the corner portion in this manner, the corner portions and the crossing portions between the surfaces can be formed stably with small thickness, when the container is manufactured by molding a material while expanding a parison of the material to the metal mold in the manufacturing step which will be described hereinafter. Additionally, occurrence of pin holes can be minimized by employing the small curved surface in the corner portion and the crossing portion in this manner. Furthermore, in the foregoing embodiment, the use is made with the polyhedron configuration. Noting the corner portion of inner wall which is disengaged from the corresponding corner portion of outer wall, it is located faced to the maximum surface area side. If this is satisfied, the container is not limited to a polyhedron container, but it may be of bladder-like shape having a curved surface. With such a container having the curved surface configuration, it would be difficult to define the disengageable corner portion. In such a case, the portion where the curved surface is not continuous is defined as a bent portion, and the surface enclosed by the bent portions, is defined as a surface, and what is necessary is that bent portion of the inner wall disengaged from the corresponding bent portion of outer wall, is faced to the maximum area surface.

Among the foregoing embodiment of the present invention, an aspect ratio of a figure constituted by the outer wall in a particular cutting plane is remote from 1, namely, the ink container is flat and thin. The cross-sectional configuration is closer to the square when the aspect ratio is closer to 1, and the deformation of the inner wall is more limited by the outer wall, and therefore, a larger amount of the ink may remain unusably even at the central portion of the ink container at the final state. However, if the container is too flat, the capacity thereof is too small. Therefore, it is desirable that aspect ratio is determined in consideration of the conditions of the ink jet recording head or the ink jet recording apparatus with which it is used.

In the above-described embodiments, the surface having the ink supply port is faced to the bottom surface, but this is not limiting, and may be determined in accordance with the configurations of the ink jet recording head unit and the carriage for carrying it, as will be described hereinafter.

(Molding Resin Material)

The description will be made as to resin material of the ink container of the present invention. The ink container of the present invention is constituted by an inner wall containing the ink and an outer wall covering the inner wall (double wall structure). Therefore, the material of the inner wall preferably exhibits a flexibility, a high hydrophilicity and a low permeability for gasses. The material of the outer wall preferably has a high strength.

It is possible to constitute both of the inner wall and the outer wall from the same resin material which satisfy all of such properties. Generally, however, it is preferable to form the inner wall and the outer wall from other materials, since then larger choice of the material is usable, and the materials which are not bonded to each other are preferable from the standpoint of easy container manufacturing, as will be described hereinafter.

The container according to FIG. 1 embodiment, was manufactured using polypropylene resin material, polyethylene resin material and Noryl, as molding resin materials. The Noryl resin hardly has a crystalline structure, and is non-crytaline, but the polypropylene resin material and the polyethylene resin material have the crystal property.

Generally, noncrystalline resin has a smaller coefficient of thermal contraction, and crystalline resin has a larger coefficient of thermal contraction.

Plastic material such as polystyrene, polycarbonate, polyvinyl chloride, and the like, may be listed as noncrystalline materials. Polyacetal, polyamide, and the like, may be listed as crystalline material since each of them forms crystalline structure by a certain ratio when placed in a specific environment.

Polyacetal, polyamide, and the like, may be listed as crystalline material since each of them forms crystalline structure by a certain ratio when placed in a specific environment. On the other hand, noncrystalline plastic has a glass transition temperature, but no distinct melting point.

The mechanical strength, specific volume, specific heat, coefficient of expansion, or the like, of plastic material suddenly changes at the glass transition point or the melding point. This property of plastic material can be utilized to create such material combinations that improve the separability of the inner shell resin from the outer shell resin. For example, when Noryl resin, which is noncrystalline, is used for the outer shell or wall, and polypropylene resin, which is crystalline, is used for the inner shell or wall, the outer shell will be provided with mechanical strength, and the inner shell will be provided with flexibility and a larger coefficient of thermal contraction.

A polymer whose molecular structure comprises only C—C bonds and C—H bonds is called a nonpolar polymer, whereas a polymer whose molecular structure comprises a large amount of polar atoms such as O, S, N or halogen is called polar polymer. Polar polymer displays larger intermolecular cohesive force; therefore, polar polymer resin displays stronger bonding force.

This property of polymer resin can be used to improve the separability of resin material; a combination of two nonpolar resins, or a combination of a nonpolar resin and a polar resin, can be used to improve the separability of one resin material from the other resin material. In the preceding embodiments, the outer wall and the inner wall were described as a wall with single layer walls. However, these walls may be given a laminar structure comprising multiple layers of different materials in order to improve shock resistance. In particular, damage which occurs when an ink container is transported or installed, or in the like situations, can be prevented by giving the outer wall the multi-layer wall structure.

As for the material for the inner wall of the ink container in accordance with the present invention, polyethylene resin, polypropylene resin, and the like, are usable as described above, and their tensile elastic modulus are preferred to be within a range of 150–3000 kgf/cm2. In this range, proper materials not limited to the resin materials are selectable with proper configuration and thickness so as to provide a desired negative pressure producing property.

(Manufacturing Method)

The description will be made as to the manufacturing method for the ink container of the present invention. The ink container proposed by the present invention employs a double structure composed of formable resin material. The outer wall is rendered thicker for strength, whereas the inner wall is rendered thinner for flexibility so that it can accommodate the volumetric change of the ink held therein. The material for the structural walls of the inner wall is preferably ink resistant, and the material for the structural walls of the outer wall is preferred to have shock resistance or the like properties.

In this embodiment, a method using blow molding is employed so that structural walls of the ink container can be formed without drawing the resin materials. Therefore, the inner wall of the ink container, which constitutes the ink holding portion, is enabled to substantially omnidirectionally withstand the load. As a result, no matter which direction the ink remaining in the inner wall shifts after the ink contained in the inner wall is consumed by a certain amount, the inner wall can reliably retain the ink, thus further improving the overall durability of the ink container.

As for the choice of blow molding, injection blow molding, direct blow molding, double wall blow molding, and the like are available.

In this embodiment, any of the blow molding methods are usable. Here, the manufacturing method will be described, taking the direct blow molding method as an example.

Figure 7:
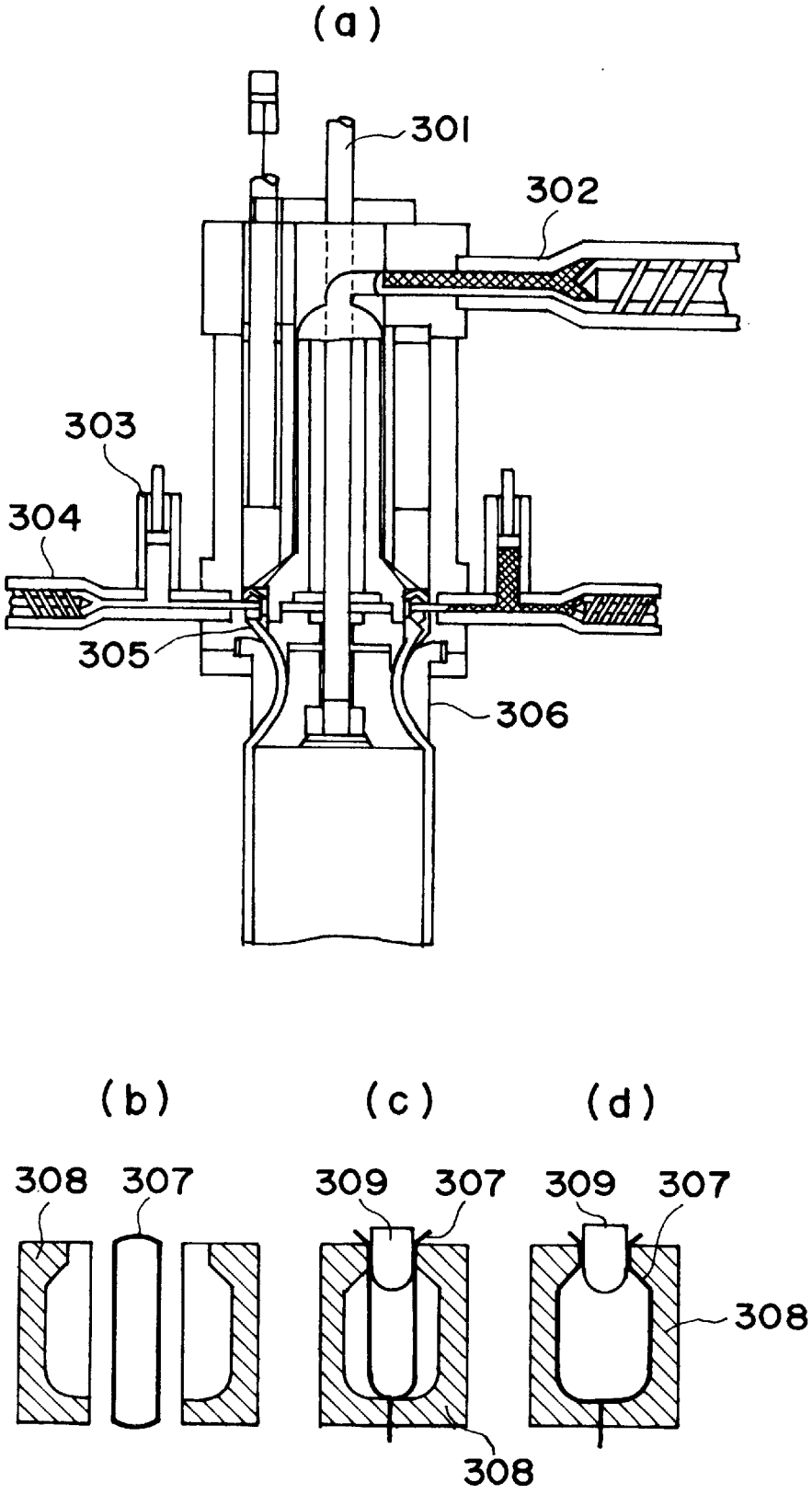
FIGS. 7(*a*), 7(*b*), 7(*c*) and 7(*d*) ink container manufacturing steps of an embodiment of the present invention.
Figure 8:
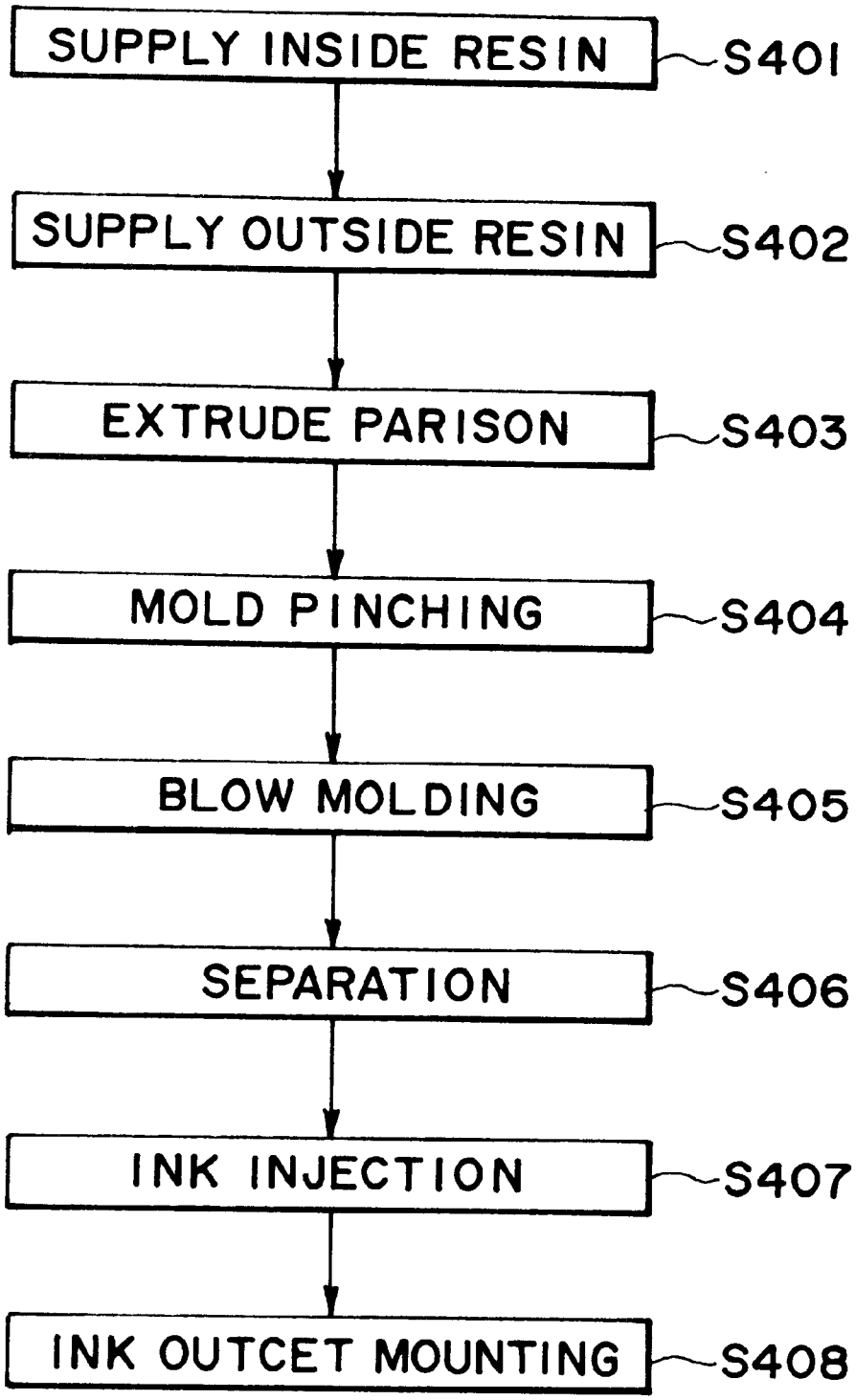
FIG. 8 is a flow chart showing an ink container manufacturing process according to an embodiment of the present invention.

FIGS. 7(*a*)–(*d*), shows ink container manufacturing steps according to this embodiment, and FIG. 8 is a flow chart showing the ink container manufacturing process.

In FIG. 7, a reference numeral 301 designates a main accumulator for supplying the resin material for the inner wall; 302, a main extruder for extruding the inner wall resin; 303, an auxiliary accumulator for supplying the resin material for the outer wall; and 304 designates an auxiliary extruder for extruding the outer wall resin.

The inner wall resin and the outer wall resin are supplied simultaneously to the die 306 through a ring 305, so that integral parison 307 is formed. The parison 307 is molded by metal molds 308 sandwiching the parison 307 and the air nozzle 309 for injecting the air from the upper part, as shown in FIGS. 7(*b*) to (*d*). Referring to FIG. 8, the ink container manufacturing process will be described in detail.

The inner resin material and the outside resin material are supplied (steps S401 and S402) to extrude the parison 307 (step S403)).

In this embodiment, the resin materials are supplied in the manner that inner resin material for the inner wall and the outer resin material for the outer wall are in contact with each other. However, the contact surfaces thereof are of materials not bonded to each other by selection of the materials of the surfaces, so that resin materials are not fused to each other. In the supply of the inner and outer resin materials, they may be contacted entirely, or partly. In this case, the resin materials for the inner and outer wall are selected so that mutually facing surfaces of the respective walls do not adhere to each other or so that they are separable by adding a proper chemical compound to one of the resin materials when the resin material is supplied to the mold, for example. When it is necessary to use materials belonging to the same group for the sake of the liquid contact related properties or the configuration of the ink container, the inner shell wall and the outer shell wall are given a laminar structure, wherein various resin materials are injected so that different materials are exposed on the mutually facing surfaces of the respective shells.

It is ideal to mold the inner shell so that wall thickness becomes even throughout the shell, but the wall thickness may be locally reduced so that wall can easily accommodate the change in internal pressure. The method for partially reducing the wall thickness is optionally selected depending on the internal structure of the liquid container, and the wall thickness is reduced in the direction parallel to the direction in which the resins are injected into the die.

A die (metallic die) 308 is placed so as to be prepared for enclosing the parison 307, as shown in FIG. 7(*b*), and then is moved to enclose the parison 307 as shown in FIG. 7(*c*) (step S404). At this time, the inner wall and the outer wall are closely contacted without gap therebetween, however, it is desirable that welded portion(pinch-off portion) does not exist in the maximum surface area side of the liquid accommodating container, by for example designing such that mold dividing direction of the mold is in parallel with the maximum area side. By the provision of the small curved surface at the corner portion, the manufacturing of the metal mold is made easier, thus improving the productivity, and therefore, the cost of the ink container manufacturing is substantially lowered.

Subsequently, as shown in FIG. 7(*c*), the air is injected through the air nozzle 309, and the blow molding is carried out to the shape of the mold 308 (step S405). As is contrasted to a conventional blow molding products, by selecting the inner and outer materials which do not show adhesiveness relative to each other, the wall are not easily adhered to each other, and a double wall structure can be provided. Further, when the die temperature is kept within a range of ±30° C. from a reference temperature while molding, difference in the wall thickness among the ink containers can be reduced during the manufacturing; therefore, such a temperature control is preferable.

Subsequently, the inner and outer wall are separated in the portion other than the ink supplying portion (step S406). The separation between the inner wall and the outer wall, may be carried out by reducing the pressure in the space defined by the ink container inner wall. As regards a method for the separation between the inner wall and the outer wall other than the pressure reduction, there is a method of using materials having different thermal expansion coefficients (shrinkage rates) for the resin materials of the inner wall and the outer wall. In this case, by the lowering of the temperature of the resin materials after the blow molding, the separation is automatically effected so that number of steps in the manufacturing is reduced. As another method, the inner wall and the outer wall may be separated by external force after molding at a portion where the parison was sandwiched by the dies at the time of the blow molding, and the resulting gap may be communicated with the ambient air, so that gap may be used as an air vent. This is preferable in the case of the ink accommodating container for the ink jet recording, since the number of the manufacturing steps can be reduced.

In this manner, the inner wall is separated from the outer wall, and thereafter, the ink is injected. Before the ink injection, the ink accommodating portion may be expanded by compressed air to provide the same shape as in the initial stage of the container, and then the ink injection may be carried out. In addition, when the ink accommodating portion is expanded into the initial state shape, the ink may be injected by pressurization.

The amount of the ink injected is preferably approx. 90–95% of the volume of the ink accommodating portion, since then the ink leakage can be prevented even upon ambient condition variations, such as temperature and/or pressure variations, or even upon external force exerted thereto. What is desirable here is that ink amount is finally 90%, and therefore, the ink may be filled into the container to 100%, and then, 5%–10% of the ink is extracted. The extraction of the ink may be carried out by exerting external force to the outer wall of the ink container. In this case, too, an air vent can be simultaneously provided by the gap provided by the separation. After the injection of the ink in this manner, the ink discharge permission member is mounted (step S408).

In the blow molding, the parison 307 is processed while it as a substantial viscosity, and therefore, neither of the inner wall resin material and the outer wall resin material has an orientation property. In the case that inner resin material and the outer resin material are supplied into the mold without contact from the beginning, the outer resin material is sucked in the mold, and thereafter, air is fed into between the inner and outer resin materials, and then, the blow molding is carried out. In this case, the resin materials may be the same materials, thus permitting selection of the resin materials form wider range.

The ink container is molded so that thicknesses t and T of the inner wall resin and the outer wall resin, respectively, before the blow molding, become smaller than the thicknesses t1 and T1 of the inner wall resin and the outer wall resin, respectively, after the blow molding. According to an aspect of the present invention, the ink container is molded so that relationship in thickness between the outer wall resin and the inner wall resin materials satisfy the following formula:

$$T>t, \text{ and } T1>t1$$

The employment of blow molding can reduce the number of manufacturing steps and the number of the components, which in turn can improve yield, and also allows the inner wall 102 to be formed in such a manner that edges and corners of the inner wall 102 are set in those of the outer wall 101 in an orderly manner.

Figure 9:
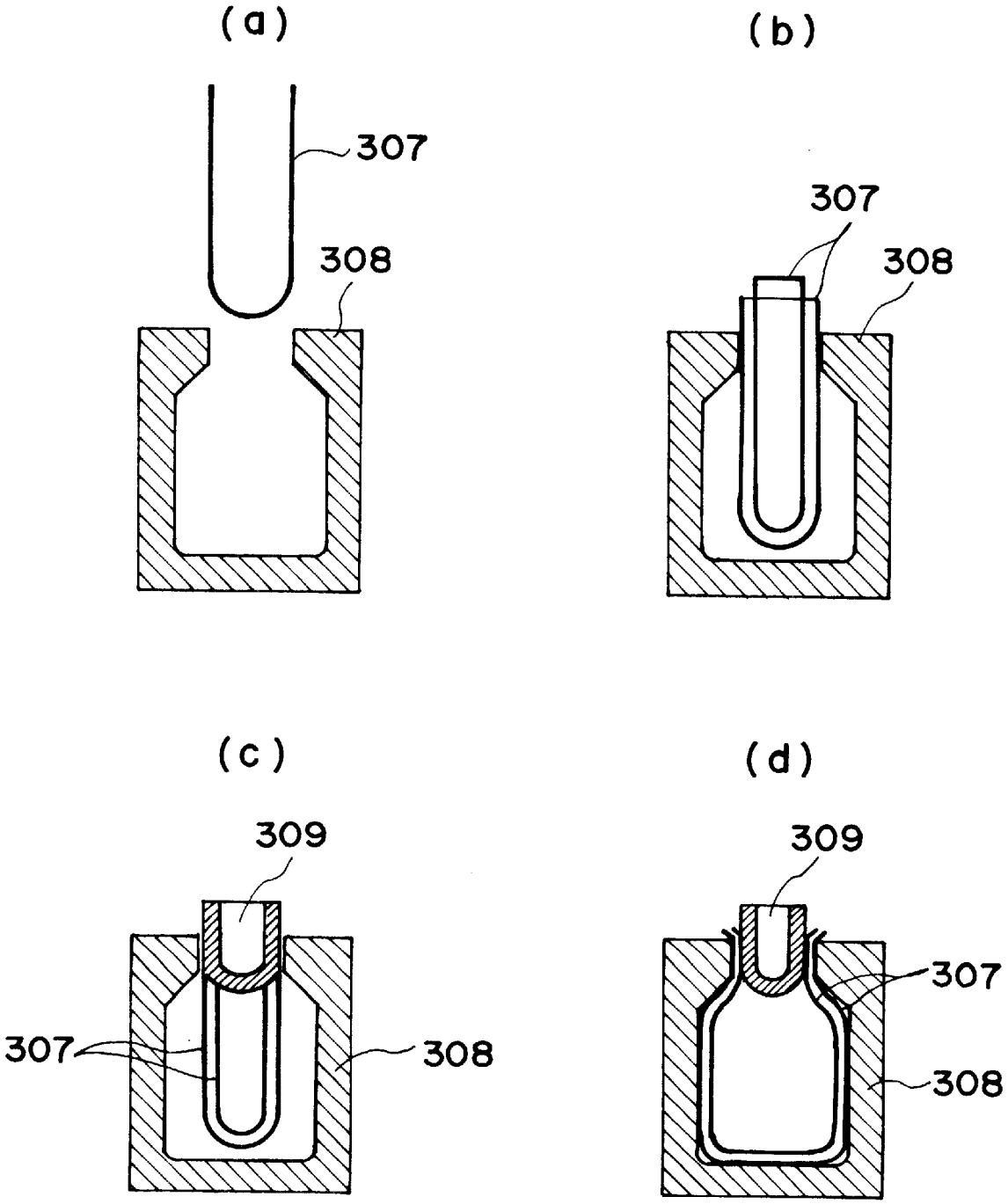
FIGS. 9(*a*), 9(*b*), 9(*c*) and 9(*d*) manufacturing steps for an ink container of the present invention using injection blow molding.
Figure 10:
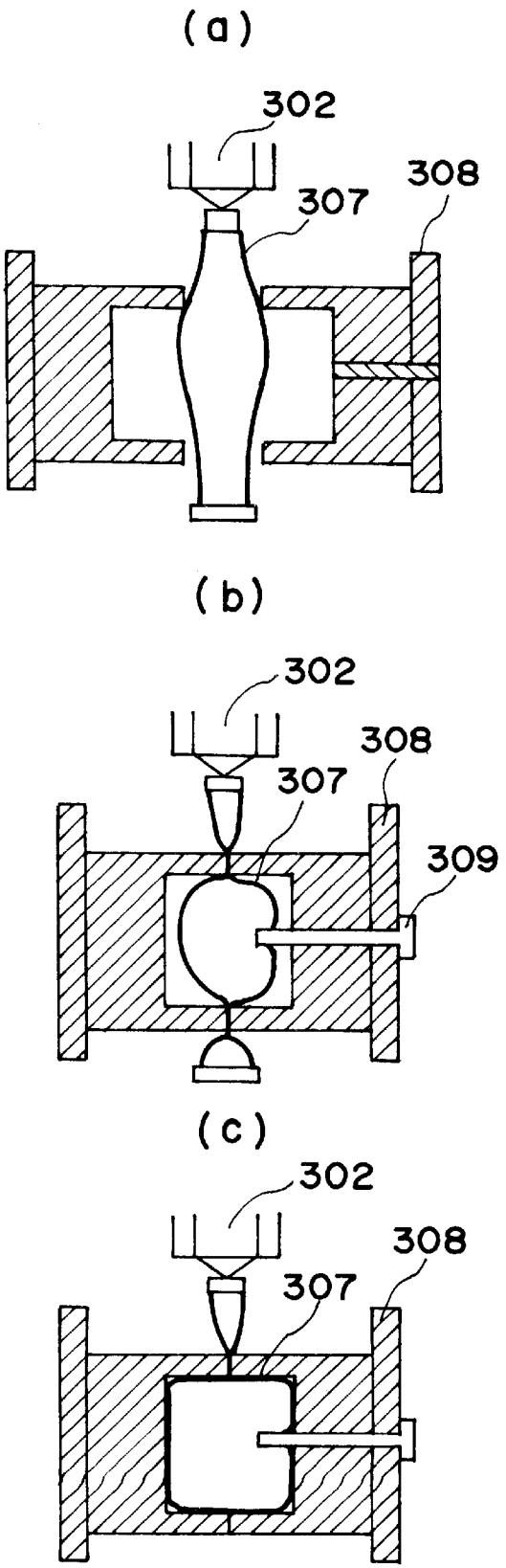
FIGS. 10(*a*), 10(*b*), 10(*c*) and 10(*d*) manufacturing steps of an ink container of the present invention using double wall blow molding.

In this embodiment, the use is made with the direct blow molding method, but other blow molding methods are usable. Referring to FIGS. 9 and 10, the description will be made as to such manufacturing processes.

In the case that ink container is manufactured using the injection blow molding, the following steps are carried out. First, the container outer wall is prepared using a preformed parison (FIG. 9(*a*)). Into this, the parison for the inner wall is inserted after it is heated (FIG. 9(*b*)), and the blow molding is carried out (FIG. 9(*c*)). Then, the inner wall and outer wall are welded with each other to accomplish the container (FIG. 9(*d*)).

In this case, a combination of the material of the outer wall and the material of the inner wall may be any if they are weldable with each other. While blow molding, it is important to properly control the parison temperature. In the case of this method, only one opening is usually provided because of the manufacturing method, and the inner wall and the outer wall are fixed with each other at the opening. Therefore, in the case that space between the inner wall and the outer wall is communicated with the ambience, an additional step of providing an air vent is necessary. When a double wall blow molding method is used, the air is first introduced into the inside of the parison to expand it, (FIG. 10(*a*)), and then, the metal mold is closed to mold the material (FIG. 10(*b*)). The left and right metal molds are closed, and then, blowing air is fed into the parison to expand the parison into the shape of the cavity provided by the molds (FIG. 10(*c*)).

At this time, the adhesiveness to the metal mold can be enhanced by sucking the inside of the metal mold, using vacuum. The container can be manufactured through this method. When the double wall blow is used, the outer wall is sandwiched by the molds all over the circumference, and therefore, the inner wall is separated if the resin materials have a melting property relative to each other. Therefore, the adhesive property between the resin materials are required usually.

However, with the ink container of this embodiment, the inner wall and the outer wall are separated at other than the supporting portion, and therefore, the adhesive property is not particularly required. The ink accommodating portion is formed by plugging the opening of the container having the double wall structure, with a cap of the same material as the outer wall.

The air vent for communication between the space between the outer wall and the inner wall with the ambience, for the pressure adjustment, can be formed by utilizing the injecting portion, as it is, for the introduction of the blowing air.

Thus, the manufacturing of the ink container using blow molding is advantageous over the conventional manufacturing method of the ink container using a porous member as a negative pressure producing member, in that number of the manufacturing steps is smaller. In the case of the ink container using a porous material, it is generally required to provide the ink container with a filter to prevent introduction, into the ink jet recording head, foreign matter produced in the ink container when the porous member is inserted during the manufacturing step, for example. According to the manufacturing method of the ink container using the blow molding, no foreign matter is produced in the ink container, and therefore, the filter for removing the foreign matter from the ink is not necessary. Furthermore, with the structure of the embodiment, the inner wall on which the ink is deposited is separated from the outer wall and is of thin material, and therefore, it is easily taken out of the outer wall, thus permitting classified disposal or classified recycling.

In the foregoing, the resin material has been described as being continuously supplied, but it is a possible alternative that same materials are used for the inner wall and the outer wall, and a material separable from the inner and outer walls is intermittently supplied into between the parison of the inner wall and the parison of the outer wall, thus making the ink accommodating portion (inner wall) is separable from the casing (outer wall).

In the foregoing, the resin material has been described as being continuously supplied, but it is a possible alternative that same materials are used for the inner wall and the outer wall, and a material separable from the inner and outer walls is intermittently supplied into between the parison of the inner wall and the parison of the outer wall, thus making the ink accommodating portion (inner wall) is separable from the casing (outer wall). Therefore, as will be understood from the manufacturing steps, when the position of the ink supply port is deviated in the surface having the ink supply port, the distance between the parison and the mold is different at some portion, and therefore, distribution of the thickness may occur in the inner wall and the outer wall at the time of the blow molding, in some cases.

In the case of the ink container shown in FIG. 1, the parison is supplied in the longitudinal direction of the container, and therefore, there is hardly any need of taking the thickness distribution in the longitudinal direction into the consideration. But, with respect to the corner portions defined by α, β, the thicknesses of the inner and outer walls are larger toward the supply port. As regards the maximum area surfaces, when they are cut along a plane parallel to the bottom surface, there is a thickness distribution. This is because the parison of a cylindrical shape is expanded to a prism having a parallelogram cross-section, and therefore, the thicknesses of the corner portions are smaller away from the mold surface.

This is effective to positively determine the order of portions of collapses of the ink container since it is one of the factors to make the corner portion 12 adjacent the side having the ink supplying portion less easily disengageable from the corresponding outer wall.

(Other Embodiments)

Other embodiments of the present invention will be described. The following embodiments are applicable to any of the liquid accommodating containers of the foregoing embodiments.

(Ink discharge Permission Member)

The ink discharge permission member(liquid discharge permission member) indicated by 106 in FIG. 1, has an ink leakage preventing function by which when small vibration is imparted to the connecting portion for the ink jet head or when the external pressure is imparted to the container, the leakage of the ink from the ink supplying portion is prevented. In the embodiment shown in FIG. 1, the use is made with unidirectional fibrous having an ink absorbing function and therefore having meniscus retaining force. It virtually seals the ink holding portion, and when the ink tapping member of the ink jet head is inserted into the ink supply port, it enables the ink within the ink holding portion to be fed out while maintaining the airtight condition.

Depending on how the ink container 100 and the ink jet head are joined, the ink releasing member 106 as a member activatable by contact pressure may be replaced with a rubber plug, a porous material, a valve, a filter, a resin piece, or the like.

(Pinch-off Portion)

The configuration of the pinch-off portion (104 in FIG. 1, for example), is determined by the mold used in the manufacturing method of the blow molding. Therefore, in FIG. 1(*b*), the supporting portion 104 has a waveform configuration, but it may be straight if the ink supply port portion 103 is easily taken out of the mold during the manufacturing step. The length is not limited to this embodiment, and may be different.

When the direct blow molding method is used, the inner wall can be supported at a plurality of portions including the ink supply port portion without difficulty, but it is not inevitable to support it at a plurality of portions. The provision of the pinch-off portion is not inevitable if an irregular deformation of the inner wall can be prevented.

(Air Vent)

The air vent indicated by 105 in FIG. 1, for example, functions to introduce the air into between the inner wall and the outer wall when the inner wall forming the ink accommodating portion is deformed by the decrease of the volume in accordance with the consumption of the ink. In the embodiment shown in FIG. 1, the materials of the inner wall 102 and the outer wall 101 are not adhesive to each other, so that inner wall 102 can be easily separated from the outer wall 101 by application of the external force, and the resulting small gap is used as an air vent. Here, although the inner wall 102 is separated from the outer wall 101, the gap therebetween is as small as several microns to several tens microns, and therefore, the inner wall 102 is sufficiently supported by the outer wall 101. As for an example of the method for forming the gap, the inner wall is separated from the outer wall as has been described hereinbefore using residual stress or the like occurring as a result of use of different materials for the outer wall and the inner wall.

The air vent may be provided by forming a hole at a proper position of the outer wall of the ink container, without use of the gap at the welded portion provided by the external force as in this embodiment. Furthermore, as shown in FIG. 2, a valve 117 which can open to the outside may be formed in the outer wall 111 of the ink container. Such a valve function to assist the balance of the pressure to the ink container inner wall, and also functions to quickly absorb the pressure change upon occurrence of abrupt pressure change when the ink container is let fall.

(Liquid Ejection Head Cartridge)

Figure 11:
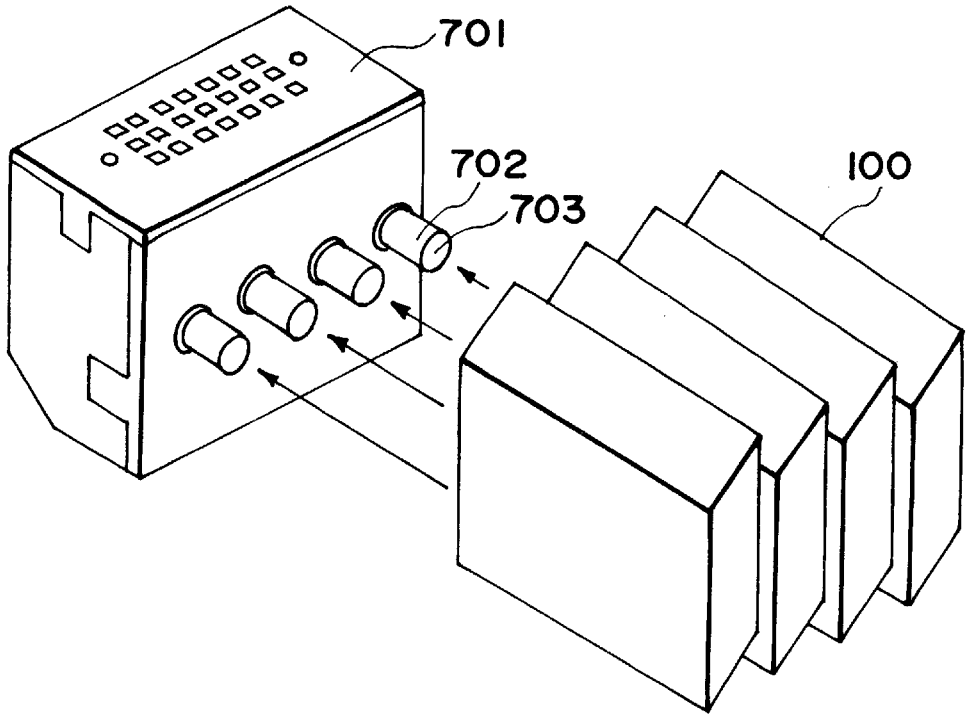
FIG. 11(*a*) is a schematic perspective view showing a recording head connectable with the ink container of the present invention, and FIG. 11(*b*) is a schematic sectional view showing a connection state between the recording head and ink container.
Figure 11:
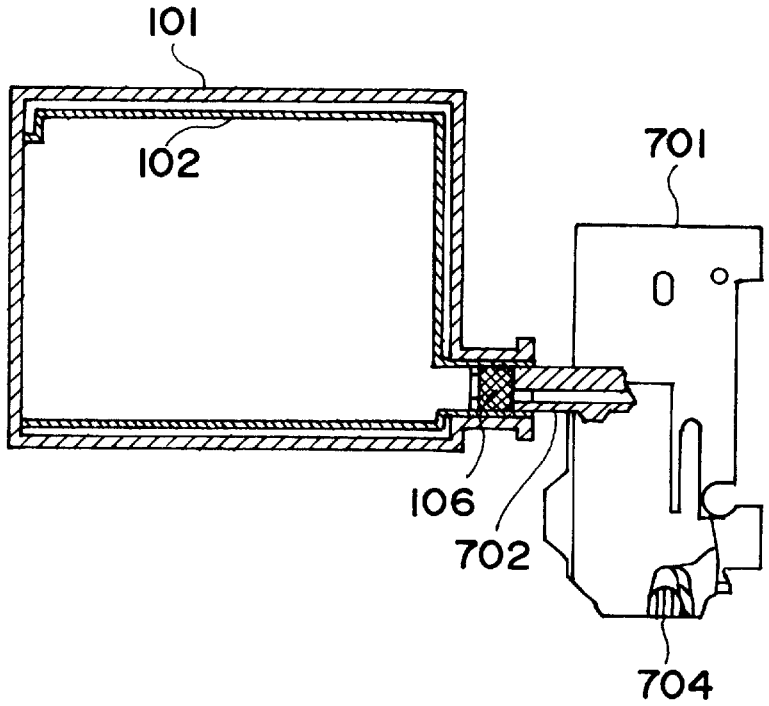

The description will be made as to connection of the ink container of the present invention to a recording head. FIG. 11(*a*) shows a recording head as a recording means connectable with the ink container according to any embodiment of the present invention, and FIG. 11(*b*) is a cross-sectional view showing the connection between the recording head and the ink container.

In FIG. 11(*a*), designated by 701 is a recording head unit as the recording means, and integrally includes black, yellow, cyan and magenta recording heads to permit full-color printing.

The recording head unit uses an electrothermal transducer which generations thermal energy for causing film boiling in the ink in response to an electric signal. Designated by 702 is an ink supply tube as an ink introduction portion for introducing the ink to the respective recording heads, and an end of the ink supply tube 702 is provided with a filter 703 for trapping bubbles or foreign matters.

When the above-described ink container 100 is mounted to the recording head unit 701, the ink supply tube 702 is connected to the press-contact member 106 provided in the ink container 100 to permit the ink supply.

After the ink container mounting, the ink is introduced into the recording head from the ink container to establish the ink communication state. Thereafter, during printing operation, the ink is ejected from the ink ejection portion 704 provided in the recording head so that ink in the ink container inner wall 102 is consumed.

In the foregoing, the ink container is disconnectably connectable with the liquid ejection recording head, but it may be integral with the liquid ejection recording head.

The liquid to be ejection is not limited to the ink, but may be processing liquid which reacts with the ink on the recording material.

(Recording Device)

Figure 12:
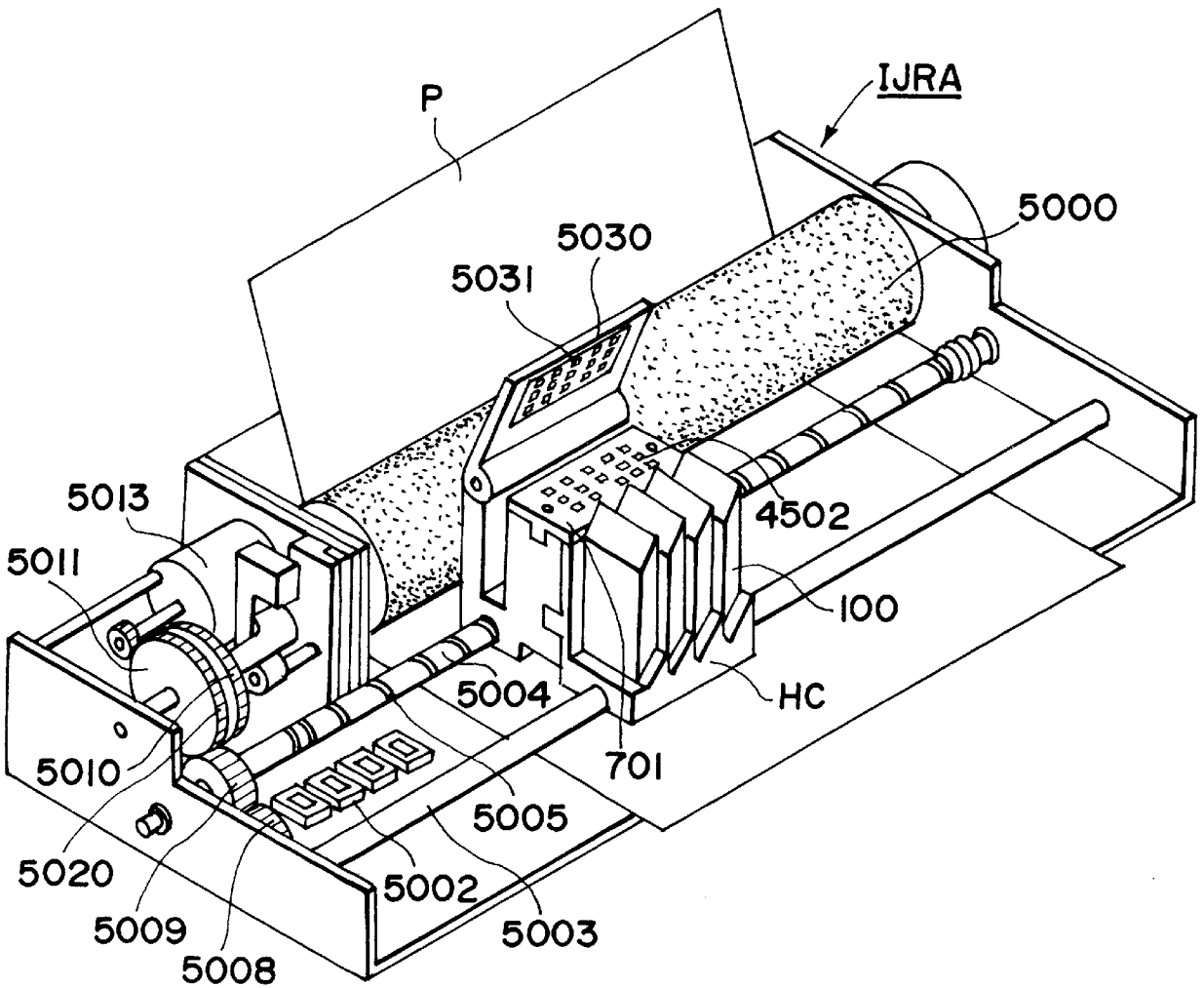
FIG. 12 is a schematic view showing an ink jet recording apparatus carrying an ink container according to an embodiment of the present invention.

Lastly, an ink jet recording apparatus in which the ink container in accordance with the present invention is mounted for recording will be described. FIG. 12 shows an example of an ink jet recording apparatus carrying the ink container according to an embodiment of the present invention of FIG. 1. In FIG. 12, the head unit 401 and the ink container 100 are securedly but removably mounted on the carriage provided on the main assembly side of the ink jet recording apparatus, with the use of an unillustrated positioning means. The forward and backward rotation of a driving motor 5013 is transmitted to a lead screw 5004 through driving force transmission gears 5011 and 5009, rotating the lead screw 5004. The lead screw 5004 is provided with a-helical groove which engages with an unillustrated pin provided on the carriage. With this arrangement, the carriage is reciprocally moved in the longitudinal direction of the apparatus.

A reference numeral 5002 designates a cap for capping the front surface of each recording head within the recording head unit. Also, it is used for restoring the recording head performance, the ink is sucked through the opening of the cap by an unillustrated sucking means. The cap 5002 is moved by the driving force transmitted through a gear 5008 and the like, being enabled to cover the ejection surface of each recording head. Adjacent to the cap 5002, an unillustrated cleaning blade is disposed so as to be movable in the vertical direction of this drawing. The configuration of the blade is not limited to the form depicted in the drawing, and needless to say, any known cleaning blade is compatible with the present invention. The apparatus is structured so that appropriate operation among the capping, cleaning, and performance recovery sucking operations is performed at a pertinent position by the function of the lead screw 505 when the carriage is at its home position, it is also needless to say that any structure is compatible with the present invention as long as the structure can enable a proper operation to be performed with known timing.

When the recording head unit is mounted on the carriage, the connection pad 4502 of the recording head unit is connected to the connection pad 531 of a connection plate 5030 provided on the carriage, whereby electrical connection is established. This connection occurs as the connection pad 50 30 is rotated about its axis. Since this electrical connection is established without using a connector, the recording head is not subjected to unnecessary force.

According to this embodiment, as shown in FIG. 12, the carriage bottom surface portion has a configuration corresponding to a part of the outer surface of the ink container outer wall so as to permit assured support for the ink container. To further assure the support for the ink container, a groove of a shape corresponding to the ink container is provided in the connecting plate 5030 so that connecting plate 5030 is rotatable about a predetermined axis to confine the upper part of the ink container.

As described in the foregoing, according to the present invention, the liquid supply is possible with stabilized negative pressure.

By using the blow molding for the manufacturing thereof, the hermeticality is better than an ink container manufactured by welding and boding a plurality of parts. Additionally, no foreign matter is produced therein during the manufacturing step, so that necessity for the filter for the foreign matter may be eliminated. No liquid retaining material such as sponge is necessary in the liquid accommodating portion, so that liquid which can be retained in the container is selectable from wider range, and the liquid accommodation capacity is large. Further, the number of ink container components is reduced; therefore, it is possible to reduce the number of quality control provisions, to simplify the ink container manufacturing process, and to easily meet a practical level of accuracy re Hired with manufacturing the ink container. As a result, it is possible to provide an inexpensive ink container manufacturable with a preferable yield.

When the container is used for a liquid supply system using a static head difference, the size of the entire apparatus can be reduced.

While the invention has been described with reference to the structures disclosed herein, it is not confined to the details set forth and this application is intended to cover such modifications or changes as may come within the purposes of the improvements or the scope of the following claims.

What is claimed is:

1. A liquid container for an ink jet recording apparatus comprising:

a polyhedron outer wall having a substantial air vent and having a corner portion defined by extensions of two surfaces thereof;

an inner wall forming a liquid containing portion for containing liquid therein, said inner wall including an outer surface contoured substantially similar to an inner shape of said outer wall, and having a corner portion corresponding to the corner portion of said outer wall; and a liquid supply portion for supplying the liquid from the liquid containing portion to outside;

wherein said inner wall and said outer wall have major surfaces having maximum areas and are not provided with said liquid supply portion; and wherein when the liquid is discharged through said liquid supply portion, said inner wall deforms with the delivery of the liquid therefrom, while generating a negative pressure such that at least one of angles formed between one side constituting a polygonal shape in a plane perpendicular to a major surface of said inner wall of said liquid container and sides adjacent thereto, decreases, and such that angles formed between sides forming decreasing angle sides and sides which are not the decreasing angle sides, increase.

2. A container according to claim 1, wherein an outer side of said inner wall is all separated physically from said outer wall except for a welded portion which is closely contacted to said outer wall.

3. A container according to claim 1, wherein a pinch-off portion where said inner wall is pinched by said outer wall, is provided at a wall portion other than the major surfaces.

4. A container according to claim 3, wherein a plurality of pinch-off portions are provided at opposite positions.

5. A container according to claim 1, wherein said liquid supply portion is provided with a liquid discharge permission member.

6. A liquid container for an ink jet recording apparatus comprising:

a polyhedron outer wall having a substantial air vent and having a corner portion defined by extensions of two surfaces thereof;

an inner wall forming a liquid containing portion for containing liquid therein, said inner wall including an outer surface contoured substantially similar to an inner shape of said outer wall, and having a corner portion corresponding to the corner portion of said outer wall; and a liquid supply portion for supplying the liquid from the liquid containing portion to outside;

wherein said inner wall and said outer wall have major surfaces having maximum areas and are not provided with said liquid supply portion; and wherein said liquid containing portion deforms with delivery of the liquid therefrom while generating a negative pressure; and wherein at least one of angles formed between one side constituting a polygonal shape in a plane perpendicular to a major surface of said inner wall of said liquid container and sides adjacent thereto is larger than 0 degrees and smaller than 90 degrees; and wherein angles formed between sides forming a decreasing angle and sides which are adjacent to the decreasing angle sides and which are not the decreasing angle sides, are larger than 90 degrees and smaller than 180 degrees.

7. A container according to claim 6, wherein a pinch-off portion where said inner wall is pinched by said outer wall, is provided at a wall portion other than the major surfaces.

8. A container according to claim 6, wherein said liquid container is of substantially parallel hexahedron configuration.

9. A container according to claim 6, wherein said outer wall covers said inner wall with a space therebetween.

10. A container according to claim 6, wherein said liquid containing portion contains liquid, and said liquid supply portion is provided with a liquid discharge permission member.

11. A liquid container for an ink jet recording apparatus comprising:

a polyhedron outer wall having a substantial air vent and having a corner portion defined by extensions of two surfaces thereof;

an inner wall forming a liquid containing portion for containing liquid therein, said inner wall including an outer surface contoured substantially similar to an inner shape of said outer wall, and having a corner portion corresponding to the corner portion of said outer wall; and a liquid supply portion for supplying the liquid from the liquid containing portion to outside; and wherein the corner portion of said inner wall includes a first corner portion which is disengageable from a corresponding corner portion of said outer wall when the liquid is discharged and a second corner portion which is retained even when the liquid is discharged so that said first corner portion and said second corner portion are effective to generate a negative pressure in accordance with deformation of said liquid containing portion.

12. A container according to claim 11, wherein said inner and outer walls have major surfaces having maximum areas, and said liquid supply portion is provided in surfaces of said inner and outer walls other than the major surfaces.

13. A container according to claim 12, wherein a pinch-off portion where said inner wall is pinched by said outer wall, is provided at a wall portion other than the major surfaces.

14. A container according to claim 11, wherein the corner portions of said inner wall and said outer wall are curved.

15. A liquid container for ink jet recording comprising:

an outer wall provided with a substantial air vent;

an inner wall forming a liquid containing portion for containing liquid therein, said inner wall including an outer surface contoured substantially similar to an inner shape of said outer wall; and a liquid supply portion for supplying the liquid from the liquid containing portion to outside; and wherein said liquid containing portion deforms with delivery of the liquid therefrom while generating a negative pressure; and wherein said inner wall has a bent portion which is disengageable from a corresponding portion of said outer wall when the liquid is discharged, said bent portion being provided at a position faced to a major surface of said outer wall having a maximum area.

16. A container according to claim 15, wherein said inner wall and said outer wall are of resin materials, and the resin material of the inner wall and the resin material of the outer wall have different heat contraction rates.

17. A container according to claim 15, wherein said inner wall and said outer wall are of resin materials, and the resin material of said inner wall is of crystal property, and the resin material of said outer wall is of non-crystal property.

18. A container according to claim 15, wherein said inner wall and said outer wall are of resin materials, and at least one of said resin materials constituting said inner and outer walls, is non-polar.

19. A liquid ejection head cartridge having a liquid container for containing liquid and a liquid ejection recording head connected to a liquid supply portion of said liquid container, comprising:

said liquid container including:

an outer wall provided with a liquid accommodating container air vent;

an inner wall forming a liquid containing portion for containing liquid therein, said inner wall including an outer surface contoured substantially similar to an inner shape of said outer wall; and a liquid supply portion for supplying the liquid from the liquid containing portion to outside;

wherein said liquid containing portion deforms with delivery of the liquid therefrom while generating a negative pressure; and wherein said inner wall has a bent portion which is disengageable from a corresponding portion of said outer wall when the liquid is discharge, said bent portion being provided at a position faced to a major surface of said outer wall having a maximum area.

20. A container according to claim 19, wherein said liquid ejection recording head is detachably mountable relative to said liquid accommodating container.

21. A liquid ejecting recording apparatus, comprising:

a liquid ejection head cartridge;

said liquid ejection cartridge including:

a liquid container including an outer wall provided with a substantial air vent; an inner wall forming a liquid containing portion for containing liquid therein, said inner wall including an outer surface contoured substantially similar to an inner shape of said outer wall; and a liquid supply portion for supplying the liquid from the liquid containing portion to outside, said liquid containing portion deforming with delivery of the liquid therefrom while generating a negative pressure; wherein said inner wall has a bent portion which is disengageable from a corresponding portion of said outer wall when the liquid is discharged, said bent portion being provided at a position faced to a major surface of said outer wall having a maximum area; and a liquid ejection head connectable with the liquid supply portion of said liquid container;

said apparatus further comprising a carriage for scanning motion, said cartridge being detachably mounted on said carriage.

22. A container according to claim 21, wherein after molding of said liquid container, the inner wall and the outer wall are separated from each other, and ink is injected into said container.

* * * * *

UNITED STATES PATENT AND TRADEMARK OFFICE

CERTIFICATE OF CORRECTION

PATENT NO. : 6,290,345 B1
DATED : September 18, 2001
INVENTOR(S) : Toshiaki Sasaki et al.

It is certified that error appears in the above-identified patent and that said Letters Patent is hereby corrected as shown below:

Title page,
Item [56] References Cited, FOREIGN PATENT DOCUMENTS,
"56067269" should read -- 56-067269 --;
"4267727" should read -- 4-267727 --;
"4339759" should read -- 4-339759 --;
"5213372" should read -- 5-213372 --;
"5213373" should read -- 5-213373 --;
"5254144" should read -- 5-254144 --;
"06226993" should read -- 6-226993 --; and
"6211243" should read -- 6-211243 --.

Item [57] ABSTRACT,
Line 8, "a" should read -- and a --;
Line 11, "and" should read -- and are --; and
Line 20, "increases." should read -- increase. --.

Drawings,
Figure 8, "OUTCET" should read -- OUTLET --.

Column 1,
Line 22, "a" should be deleted;
Line 23, "a" should be deleted;
Line 39, "is" should read -- are --;
Line 40, "does" should read -- do --; and
Line 43, "result" should read -- results --.

Column 2,
Line 1, "portion(ink" should read -- portion (ink --;
Line 7, "portion(ink" should read -- portion (ink --;
Line 13, "an" should read -- a --;
Line 59, "number-of" should read -- number of --; and
Line 65, "an" should read -- a --.

UNITED STATES PATENT AND TRADEMARK OFFICE

CERTIFICATE OF CORRECTION

PATENT NO. : 6,290,345 B1
DATED : September 18, 2001
INVENTOR(S) : Toshiaki Sasaki et al.

It is certified that error appears in the above-identified patent and that said Letters Patent is hereby corrected as shown below:

Column 3,
Line 22, "a" should read -- and a --;
Line 25, "and" should read -- and are --;
Line 35, "increases." should read -- increase. --;
Line 44, "a" should read -- and a --;
Line 47, "and" should read -- and are --;
Line 52, "0 degree" should read -- 0 degrees --;
Line 66, "a" should be deleted; and
Line 67, "a" should read -- and a --.

Column 4,
Line 6, "portions" should read -- portion --;
Line 14, "a" should read -- and a --; and
Line 64, "Wherein" should read -- wherein --.

Column 5,
Line 4, "is" should read -- being --;
Line 12, "a" should read -- and a --;
Line 14, "Wherein" should read -- wherein --;
Line 32, "a" should read -- and a --;
Line 34, "Wherein" should read -- wherein --;
Line 39, "method-comprising:" should read -- method comprising: --;
Line 41, "supplying" should read -- and supplying --;
Line 54, "view" should read -- views --;
Line 57, "view" should read -- views --; and
Line 62, "views;" should read -- views --.

Column 6,
Line 4, "ink" should read -- illustrate ink --;
Line 9, "9(*d*)" should read -- 9(*d*) show --;
Line 12, "10(*d*)" should read -- 10(*d*) show --;
Line 31, "In the" should read -- The --;
Line 41, "shows" should read -- show --;
Line 44, "FIG. 2 is" should read -- FIGS. 2((*a*)-(*d*)) are --;
Line 45, "shows" should read -- show --;
Line 47, "((*a*)-(*d*))" should read -- ((*a*)-(*d*)). --;
Line 48, "illustrates" should read -- illustrate --; and
Line 60, "portion(pinch-off portion)104," should read -- portion (pinch-off portion) 104, --.

UNITED STATES PATENT AND TRADEMARK OFFICE

CERTIFICATE OF CORRECTION

PATENT NO. : 6,290,345 B1
DATED : September 18, 2001
INVENTOR(S) : Toshiaki Sasaki et al.

It is certified that error appears in the above-identified patent and that said Letters Patent is hereby corrected as shown below:

Column 7,
Line 17, "carried" should read -- is carried --;
Line 28, "0 degree" should read -- 0 degrees --;
Line 50, "FIG. 1 is a schematic view," should read -- FIGS. 1((*a*)-(*c*)) are schematic views, --; and
Line 67, "begins" should read -- begin --.

Column 9,
Line 35, "40 cm2" should read -- 40 $cm^2$ --;
Line 47, "the" (first occurrence) should be deleted; and
Line 62, "existences" should read -- exists --.

Column 10,
Line 9, "in-the" should read -- in the --;
Line 19, "a" should read -- and a --;
Line 31, "a" should read -- and a --;
Line 34, "and" should read -- and are --;
Line 35, "wherein" should read -- and wherein --;
Line 44, "increases." should read -- increase. --;
Line 46, "are" should read -- is --; and
Line 57, "FIGS. 3" should read -- FIGS. 3(*a*)-(*c*) --;

Column 11,
Line 9, "FIGS. 4(*a*)-(*d*), shows" should read -- FIGS. 4(*a*)-(*d*), show a --; and
Line 62, "embodiment" should read -- embodiments --.

Column 13,
Line 49, "FIGS. 7(*a*)-(*d*), shows" should read -- FIGS. 7(*a*)-(*d*), show --; and
Line 67, "(step S403))." should read -- (step S403). --.

Column 14,
Line 34, "portion(pinch-off" should read -- portion (pinch-off --;
Line 46, "a" should be deleted; and
Line 48, "wall" should read -- walls --.

UNITED STATES PATENT AND TRADEMARK OFFICE

CERTIFICATE OF CORRECTION

PATENT NO. : 6,290,345 B1
DATED : September 18, 2001
INVENTOR(S) : Toshiaki Sasaki et al.

It is certified that error appears in the above-identified patent and that said Letters Patent is hereby corrected as shown below:

Column 15,
Line 32, "as" should read -- has --.

Column 16,
Line 66, "is" should be deleted.

Column 17,
Line 7, "is" should be deleted;
Line 12, "portion," should read -- portions, --;
Line 30, "portion 12" should read -- portion β2 --; and
Line 39, "member(liquid" should read -- member (liquid --.

Column 18,
Line 29, "function" should read -- functions --;
Line 32, "let" should read -- allowed to --;
Line 46, "generations" should read -- generates --; and
Line 65, "ejection" should read -- ejected --.

Column 19,
Line 13, "a-helical" should read -- a helical --;
Line 20, "performance," should read -- performance; --;
Line 32, "screw 505" should read -- screw 5004 --;
Line 33, "position, it" should read -- position. It --;
Line 38, "pad 531" should read -- pad 5031 --; and
Line 41, "pad 50 30" should read -- plate 5030 --.

Column 20,
Line 1, "re Hired" should read -- required --;
Line 64, "and" should be deleted; and
Line 67, "and" should be deleted.

Column 21,
Line 35, "and" should be deleted; and
Line 60, "and" should be deleted.

UNITED STATES PATENT AND TRADEMARK OFFICE

CERTIFICATE OF CORRECTION

PATENT NO. : 6,290,345 B1
DATED : September 18, 2001
INVENTOR(S) : Toshiaki Sasaki et al.

It is certified that error appears in the above-identified patent and that said Letters Patent is hereby corrected as shown below:

Column 22,
Line 13, "walls," should read -- walls --;
Line 18, "container" should read -- container, --;
Line 33, "discharge," should read -- discharged, --;
Line 40, "cartridge;" should read -- cartridge, including: --; and
Line 41, should be deleted.

Signed and Sealed this

Fourth Day of June, 2002

*Attest:*

*Attesting Officer*

JAMES E. ROGAN
*Director of the United States Patent and Trademark Office*